US009867482B1

(12) United States Patent
Ikeno et al.

(10) Patent No.: US 9,867,482 B1
(45) Date of Patent: Jan. 16, 2018

(54) SHELVING SYSTEM WITH INTERLOCKING CONTAINERS

(71) Applicant: Amazon Technologies, Inc., Seattle, WA (US)

(72) Inventors: Hirotoshi Ikeno, Nagareyama (JP); Shigeo Eikawa, Narita (JP); Shigeo Ochida, Funabashi (JP)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 15/006,404

(22) Filed: Jan. 26, 2016

Related U.S. Application Data

(62) Division of application No. 14/164,852, filed on Jan. 27, 2014, now Pat. No. 9,290,288.
(Continued)

(51) Int. Cl.

| | |
|---|---|
| ***A47G 29/00*** | (2006.01) |
| ***A47B 43/00*** | (2006.01) |
| ***A47B 47/00*** | (2006.01) |
| ***A47B 57/00*** | (2006.01) |
| ***A47F 5/00*** | (2006.01) |
| ***A47B 96/02*** | (2006.01) |
| ***B65D 5/355*** | (2006.01) |

(Continued)

(52) U.S. Cl.
CPC ..... *A47F 5/0025* (2013.01); *A47B 43/02* (2013.01); *A47B 55/06* (2013.01); *A47B 96/021* (2013.01); *A47F 5/11* (2013.01); *A47F 5/112* (2013.01); *A47F 5/114* (2013.01); *A47F 5/116* (2013.01); *B65D 5/0005* (2013.01)

(58) Field of Classification Search
CPC ..... A47F 5/112; A47F 5/16; A47F 5/0018; A47F 5/114; A47F 5/11; A47F 5/0025; A47F 7/0028; A47F 5/005; A47F 7/144; A47F 5/132; A47F 5/10; A47F 5/108; A47F 5/116; A47B 43/02; A47B 47/06; A47B 55/06; A47B 43/00; A47B 57/58; A47B 57/588; A47B 96/04; A47B 47/0091; A47B 87/00; A47B 87/007; A47B 87/02; A47B 87/0207; A47B 87/0215; A47B 96/021; G09F 5/00; B65D 5/005; B65D 5/504; B65D 1/36; B65D 5/0015; B65D 5/2038; B65D 5/22; B65D 5/48044; B65D 5/48024
USPC ..... 211/72, 73, 195, 184, 70.1, 126.16, 135, 211/188, 194; 248/174; 206/558, 561, 206/509; 229/120.06, 120.33, 120.34, 229/120.26, 120.02, 120.24, 120.29, 178, 229/915
See application file for complete search history.

(56) References Cited

U.S. PATENT DOCUMENTS 1,116,304 A * 11/1914 Lundstrom ..... A47B 87/02 312/108
2,914,184 A 11/1959 Dgetluck
(Continued)

*Primary Examiner* — Jennifer E. Novosad
(74) *Attorney, Agent, or Firm* — Thomas Horstemeyer, LLP

(57) ABSTRACT

Disclosed are various embodiments for storage containers that may be used with a storage assembly. The storage assembly can include a shelf system and multiple containers. The shelf system can include multiple shelves, where a shelf includes multiple holes. Each container can include multiple slots and multiple tabs. The tabs of one container can be configured to be inserted through the holes of a shelf into the slots of another container.

18 Claims, 29 Drawing Sheets

Related U.S. Application Data

(60) Provisional application No. 61/758,633, filed on Jan. 30, 2013.

(51) Int. Cl.

| | |
|---|---|
| ***A47F 5/11*** | (2006.01) |
| ***A47B 55/06*** | (2006.01) |
| ***A47B 43/02*** | (2006.01) |

(56) References Cited

U.S. PATENT DOCUMENTS

| | | | | | |
|---|---|---|---|---|---|
| 2,941,670 | A | | 6/1960 | Fagan et al. | |
| 3,208,659 | A | | 9/1965 | Otto et al. | |
| 3,410,441 | A | * | 11/1968 | Rhyne | A47B 88/0014 220/4.28 |
| 3,644,008 | A | * | 2/1972 | Overby | A47B 87/0253 312/107 |
| 3,749,299 | A | | 7/1973 | Ingle | |
| 3,862,689 | A | * | 1/1975 | Taub | B65D 5/001 211/126.16 |
| 3,885,845 | A | * | 5/1975 | Krieks | A47B 67/04 312/108 |
| 3,999,662 | A | | 12/1976 | Barnhardt | |
| 4,089,574 | A | * | 5/1978 | Ford | A47B 96/021 312/108 |
| 4,153,311 | A | * | 5/1979 | Takahashi | A47B 47/042 108/162 |
| 4,228,904 | A | | 10/1980 | Dumond | |
| 4,232,916 | A | * | 11/1980 | Correia | A47B 47/042 108/53.3 |
| 4,463,997 | A | | 8/1984 | Densen | |
| 4,530,548 | A | | 7/1985 | Spamer et al. | |
| 4,753,341 | A | | 6/1988 | McIntyre | |
| 5,143,431 | A | | 9/1992 | Udell | |
| 5,443,168 | A | | 8/1995 | Dyment et al. | |
| 5,832,689 | A | * | 11/1998 | Curll | A47B 47/0041 403/170 |
| 5,964,360 | A | * | 10/1999 | Hwang | A47B 87/0215 211/186 |
| 5,984,120 | A | | 11/1999 | Johnske | |
| 6,102,217 | A | * | 8/2000 | Mathy | A47B 81/002 211/188 |
| 6,105,796 | A | | 8/2000 | Buchanan et al. | |
| 6,126,022 | A | * | 10/2000 | Merkel | A47B 47/042 108/180 |
| 6,244,502 | B1 | | 6/2001 | Hollar et al. | |
| 6,321,918 | B1 | * | 11/2001 | Rollins | A47B 87/0207 211/194 |
| 6,547,126 | B2 | | 4/2003 | Freiborg et al. | |
| 6,675,979 | B2 | * | 1/2004 | Taylor | A47B 47/042 108/153.1 |
| 6,786,337 | B2 | * | 9/2004 | Klein | A47F 7/08 211/134 |
| 6,918,497 | B2 | * | 7/2005 | Davis | A47B 47/00 211/183 |
| 7,686,173 | B2 | * | 3/2010 | Robinson | A47B 57/30 211/187 |
| 8,360,255 | B2 | | 1/2013 | Chen | |
| 9,290,288 | B1 | * | 3/2016 | Ikeno | A47F 5/116 |
| 2003/0062327 | A1 | | 4/2003 | Pickett | |
| 2008/0203038 | A1 | | 8/2008 | Pedler et al. | |
| 2009/0272756 | A1 | | 11/2009 | Hackney | |
| 2010/0108623 | A1 | | 5/2010 | Virvo | |

* cited by examiner

SHELVING SYSTEM WITH INTERLOCKING CONTAINERS

CROSS REFERENCE TO RELATED APPLICATIONS

This Application is a division of U.S. patent application Ser. No. 14/164,852, filed on Jan. 27, 2014, which claims priority to and the benefit of U.S. Provisional Application No. 61/758,633, filed on Jan. 30, 2013, which are incorporated by reference herein in their entireties

BACKGROUND

Inventory storage facilities, such as warehouses, store large numbers of a variety of items. The number and variety of items stored may change over time as items are sold, shipped, ordered, and/or received. Accordingly, the storage mechanisms used may need to adapt to the changing number and variety of items stored.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
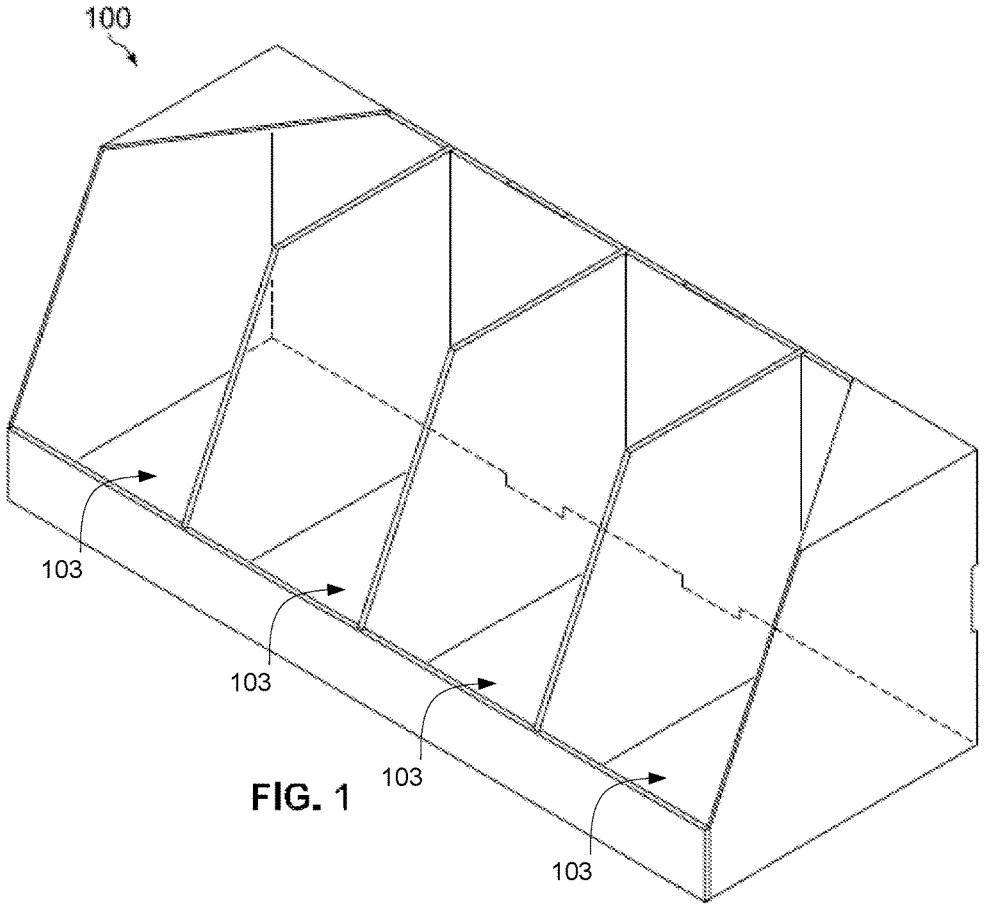
FIG. 1 is a drawing of a perspective view of a storage container according to various embodiments of the present disclosure.

In the following discussion, a general description of the system and its components is provided, followed by a discussion of the operation of the same. Described herein are embodiments of storage containers that may comprise one or more partitions and may provide easy access to persons desiring access to the contents of the storage container. Such storage containers may be assembled from flat, precut blanks that may then be folded and assembled into the storage container as needed.

Referring now to the drawings, one or more preferred embodiments of the present disclosure are described.

FIG. 1 illustrates a storage container 100 according to various embodiments of the present disclosure. As shown, the storage container 100 provides one or more partitions 103 for separating stored items. Also as shown, the storage container 100 provides access from the front to items stored therein. As illustrated, rectangular tabs may extend from the bottom of the storage container 100.

Figure 2:
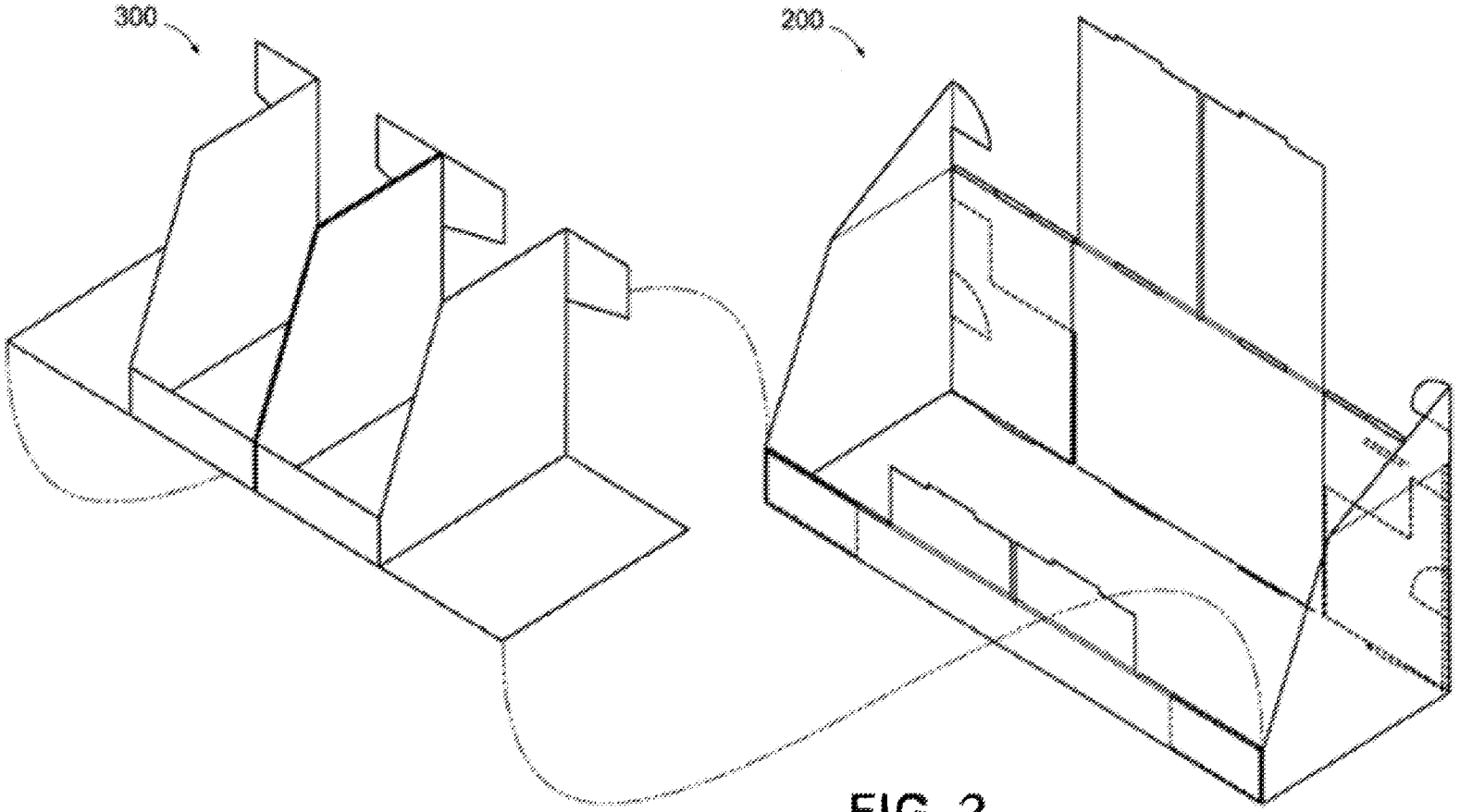
FIG. 2 is a drawing of an exploded perspective view of the storage container of FIG. 1 according to various embodiments of the present disclosure.

As further illustrated in FIG. 2, storage container 100 (FIG. 1) comprises a box assembled from a box blank 200 and an insertable divider assembled from a divider blank 300, wherein the divider assembled from the divider blank 300 is inserted into the box assembled from the box blank 200 to form a plurality of partitions within the storage container 100. Various embodiments, such as those discussed in FIGS. 19-28, may divide the storage container 100 in varying numbers of partitions depending on the number of partition panels included in the insertable divider.

Figure 3:
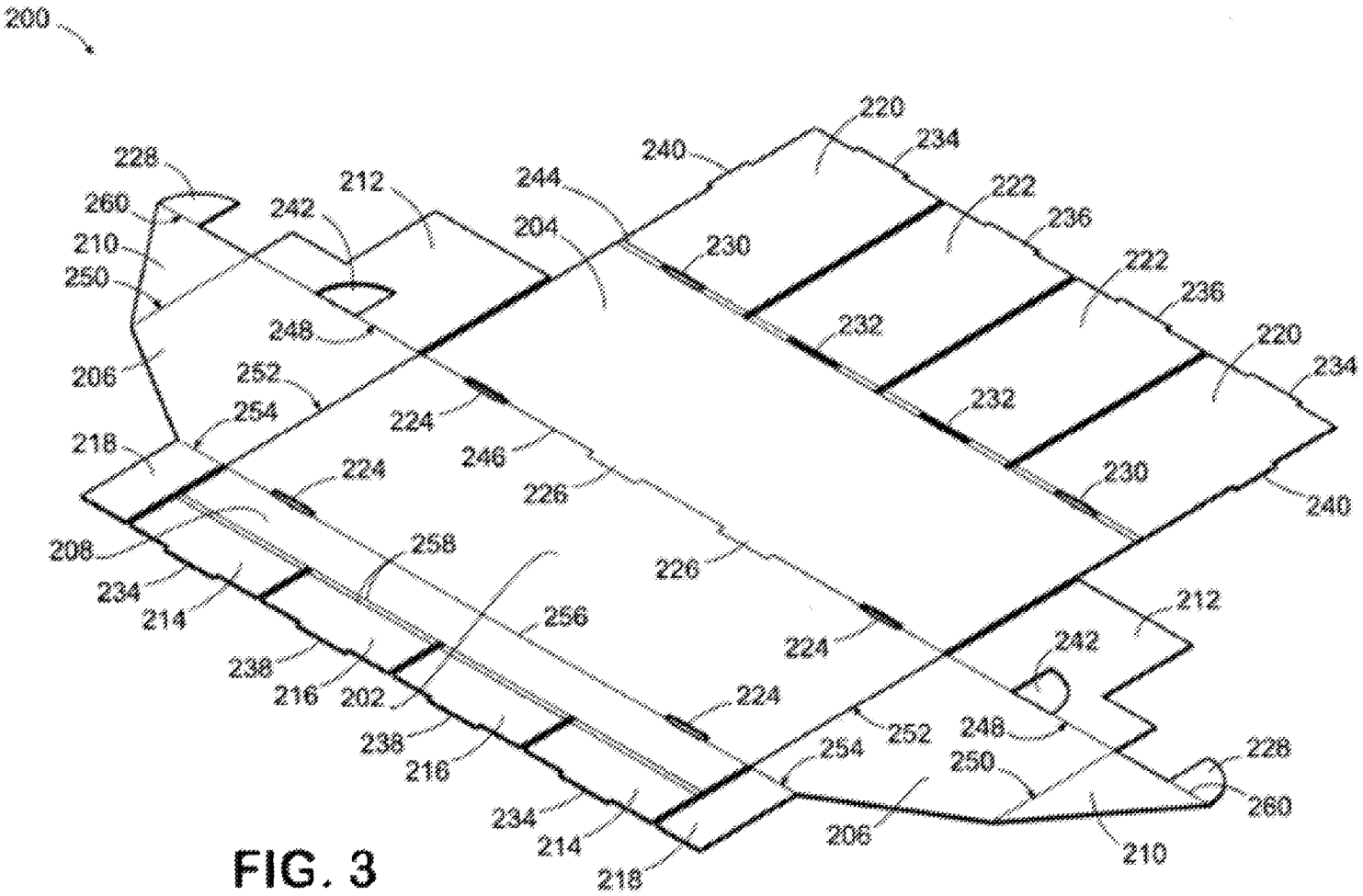
FIG. 3 is a drawing of a top plan view of an outer blank of the storage container of FIG. 1 according to various embodiments of the present disclosure.

FIG. 3 illustrates an example of a box blank 200 used to assemble the box of the storage container 100 (FIG. 1). The box blank 200 is composed of a bottom panel 202 that is connected to a back panel 204, two side panels 206, and a front panel 208. Extending from the back panel 204, side panels 206, and the front panel 208 are various inserts, flaps, tabs, flanges and protrusions that connect to various apertures and slots as will be described herein.

Extending from the top of each side panel 206 is a side flap 210. In some embodiments, the side flap 210 may be triangularly shaped although various embodiments may make use of other shapes, such as squares, wedges, portions of circles, and other such shapes. Extending from the rear edge of each side panel 206 is a back panel insert 212.

Extending from the front panel 208 are a plurality of front panel flaps. In various embodiments, there are outer front panel flaps 214 and inner front panel flaps 216. In some embodiments, the outer front panel flaps 214 may be folded over front panel inserts 218 extending from a forward edge of the side panels 206. In such embodiments, the front panel inserts 218 may be secured between the outer front panel flaps 214 and the front panel 208.

Extending from the back panel 204 are a plurality of back panel flaps. In various embodiments, there are outer back panel flaps 220 and inner back panel flaps 222. In some embodiments, the outer back panel flaps may be folded over the back panel inserts 212 extending from the rear edge of each side panel 206. In such embodiments, the back panel inserts 212 may be secured between the outer back panel flaps 220 and the back panel 204.

The bottom panel 202 includes a number of apertures and tabs. For example, various protrusions extending from the outer front panel flaps 214 and outer back panel flaps 220 may be inserted into the bottom panel apertures 224 to frictionally secure the outer front panel flaps 214 and outer back panel flaps 220 to the bottom panel 202. The bottom panel 202 may also include one or more rectangular tabs 226, which are used to interlock with other storage containers 100.

Some embodiments may also include a pie-shaped, wedge shaped, or arcing tab. For example, a quarter-circle tab 228 may extend from the side flaps 210. In such embodiments, the quarter-circle tab 228 may be positioned such that one end of the arcing edge terminates at the far corner, edge, or end from the side panel 206. In embodiments where the side flap 210 is triangularly shaped, this corner is end of the hypotenuse of the side flap 210 opposite the side panel 206. In embodiments that include the quarter-circle tab 228, the side flap 210 may be folded such that the quarter-circle tab 228 may be inserted into one of the top panel apertures 230, securing the quarter circle tab 228 between an outer back panel flap 220 and the back panel 204.

Some embodiments may include one or more rectangular slots 232 located between the inner back panel flaps 222 and the back panel 204. These rectangular slots 232 may receive rectangular tabs 226 positioned along the bottom panel 202 of another storage container 100, interlocking two storage containers 100 with each other. In various embodiments, the positions of the rectangular tabs 226 and the rectangular slots 232 may be switched, permitting rectangular tabs 226 to be inserted from underneath instead of above, as previously described.

The outer front panel flaps 214 and the outer back panel flaps 220 may have rectangular protrusions 234 extending from the side opposite the front panel 208 or the back panel 204, as illustrated. These rectangular protrusions 234 may be inserted into the bottom panel apertures 224 as previously described to frictionally secure the outer front panel flaps 214 and outer back panel flaps 220 to the bottom panel 202 while securing the front panel inserts 218 between the outer front panel flaps 214 and the front panel 208 and the back panel inserts 212 between the outer back panel flaps 220 and the back panel 204.

The inner panel flaps may have rectangular projections insertable through slots located in divider assembled from the divider blank 300 (FIG. 2) to secure the divider to the box. For example, rear rectangular projections 236 may extend from the inner back panel flaps 222. The rear rectangular projections 236 are insertable through the divider, as further described below, to secure the inner back panel flaps 222 to the divider and secure a portion of the divider between the inner back panel flaps 222 and the back panel 204. Front rectangular projections 238 may extend from the inner front panel flaps 216. The front rectangular projections 238 are insertable through slots in the divider, as further described below, to secure the inner front panel flaps 216 to the divider and secure a portion of the divider between the inner front panel flaps 216 and the front panel 208.

In some embodiments, the outer back panel flaps 220 may have a flange 240 protruding from the exterior side of the outer back panel flaps 220. The flange 240 may be insertable into a quarter-circle slot 242 located within the back panel insert 212 along the edge of the side panel 206, securing the outer back panel flap 220 to the side panel 206 and the back panel insert 212. In some embodiments, the quarter-circle slot 242 may also receive a quarter-circle tab 228 of another storage container 100 beneath the storage container 100, as will be further described herein, interlocking two storage containers 100.

In some embodiments, the box blank 200 may also be marked with one or more score lines. As used herein, a "score line" is intended to mean an elongated groove, indentation, or perforation along which a fold is predisposed to form upon application of force. A score line may be formed in a corrugated or non-corrugated panel along which the panel is predisposed to fold upon application of a force to the panel. As an illustrative and non-limiting example, a score line may be formed by notching, scratching, cutting, compressing, perforating, physically deforming, or otherwise manipulating the box blank 200. The back panel score lines 244, the rear bottom panel score lines 246, the rear side panel score lines 248, the top side panel score lines 250, the side bottom panel score lines 252, the front side panel score lines 254, the front bottom panel score lines 256, the front panel score lines 258, and the side flap score lines 260 generally facilitate folding when assembling the box blank 200 into a configuration for use as a box for the storage container 100.

Figure 6:
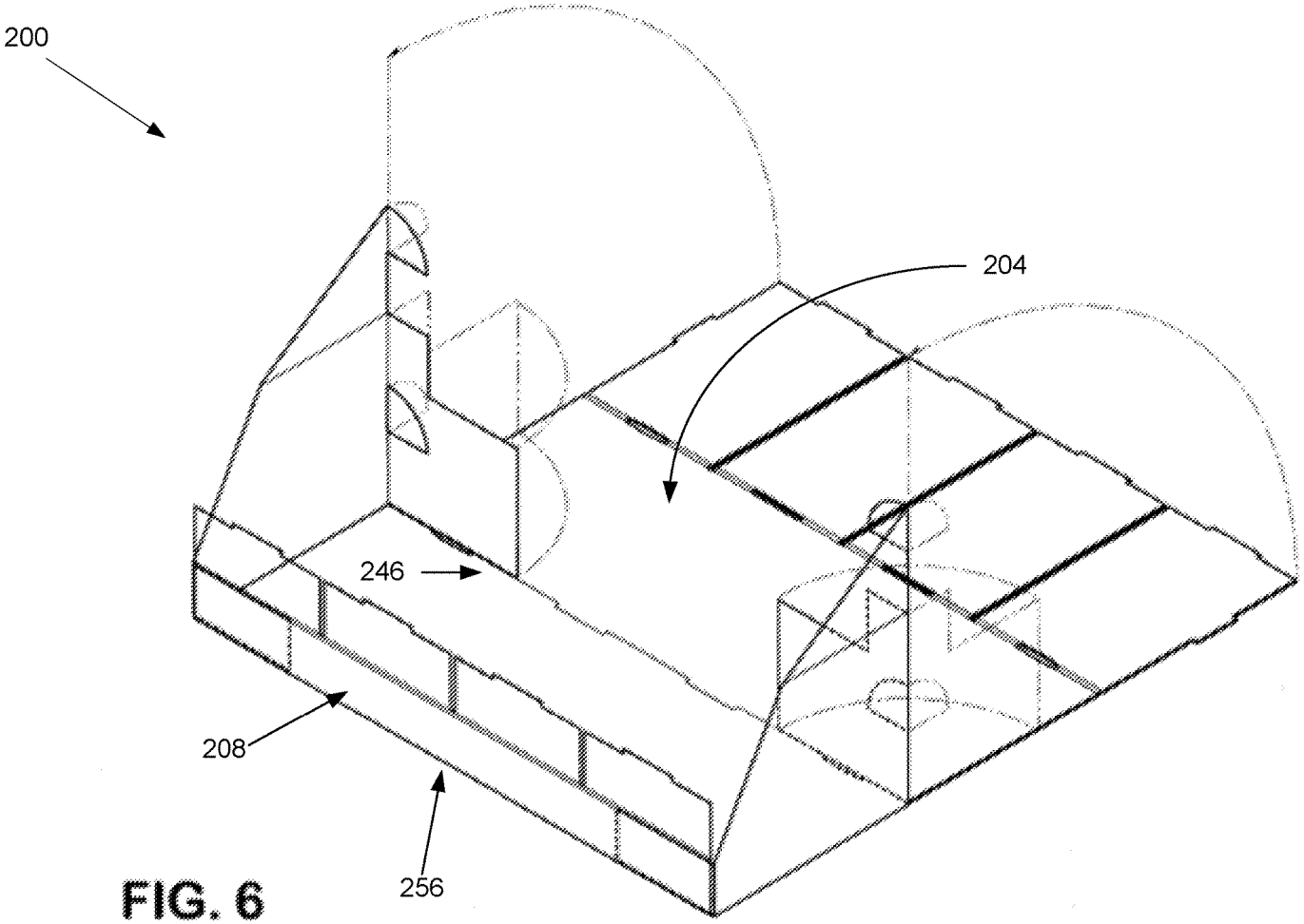
Figure 7:
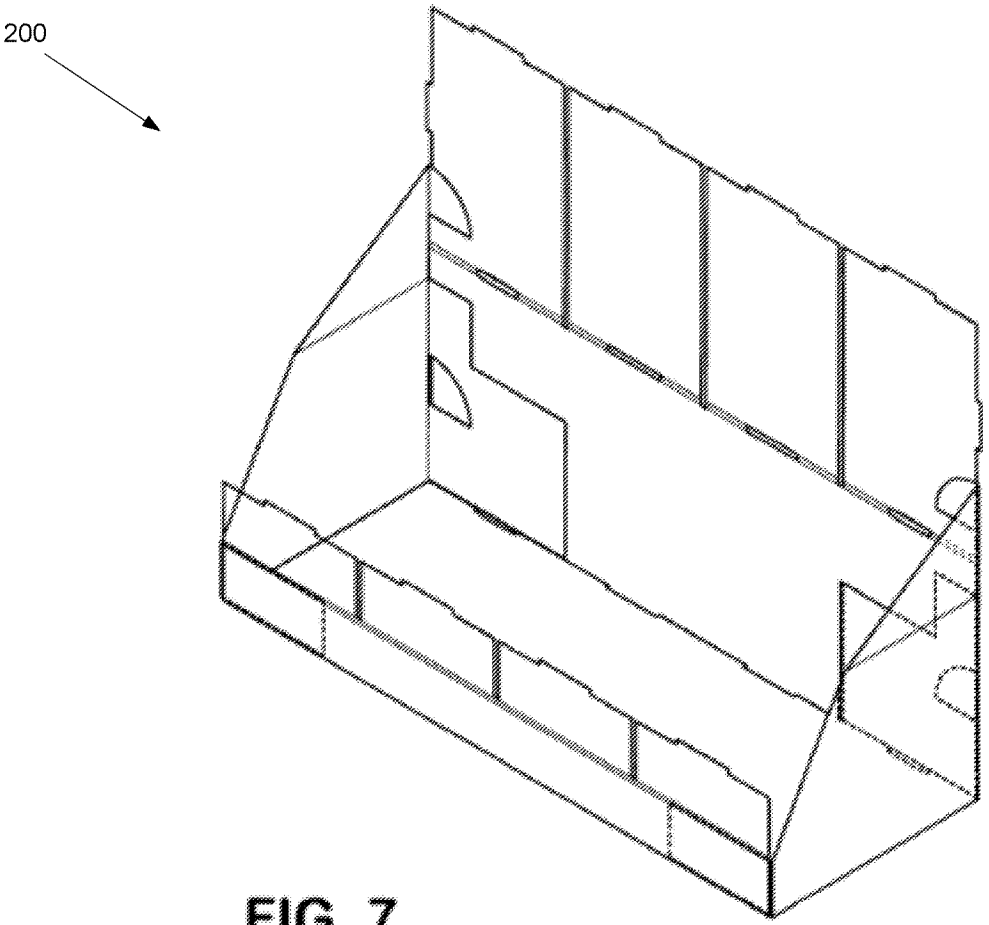
Figure 8:
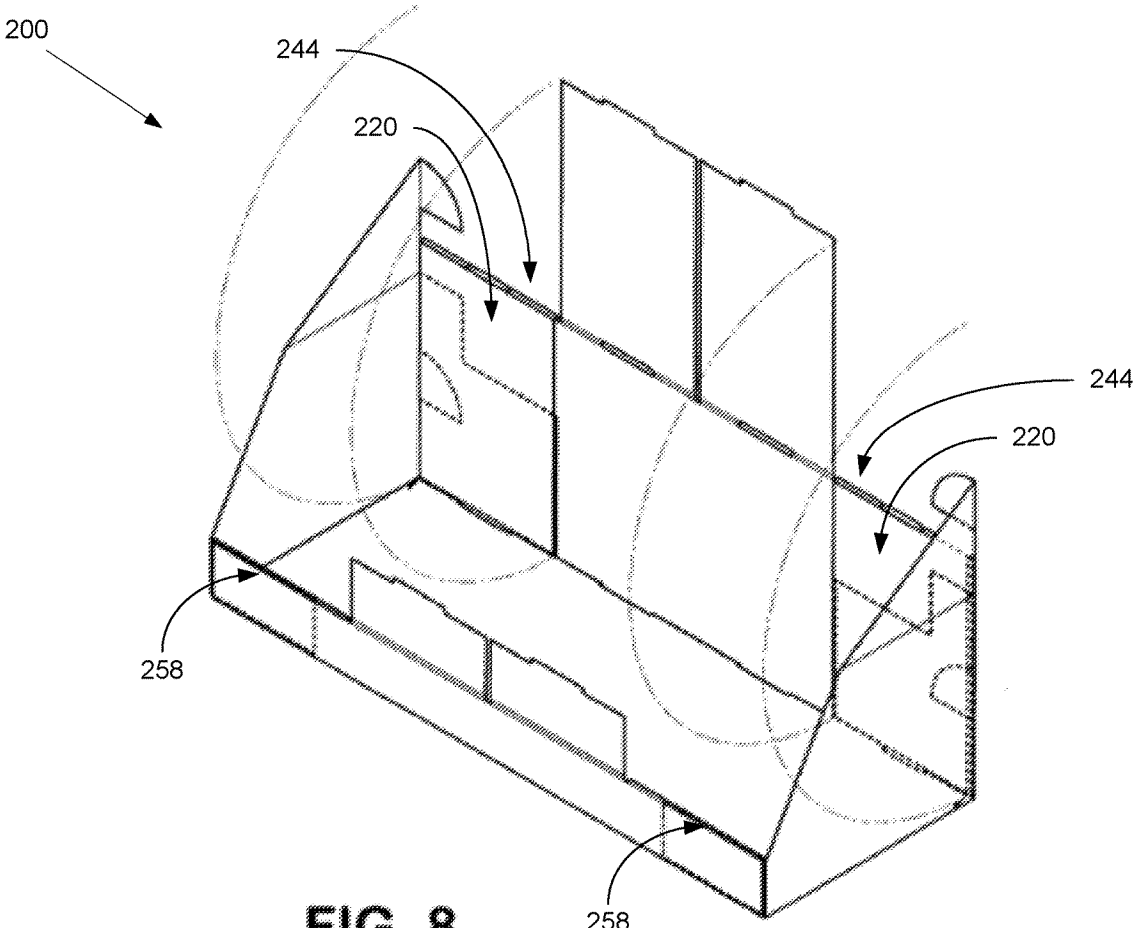

FIGS. 4-8 illustrate the process of folding the box blank 200 along the various score lines to form a box from the partially folded box blank 200 as illustrated in FIG. 8. In this partially folded configuration as shown in FIG. 8, the box is disposed to accept a divider assembled from the divider blank 300 (FIG. 2) prior to subsequently folding the remaining portions of the box blank 200 to form a storage container 100 (FIG. 1).

Figure 4:
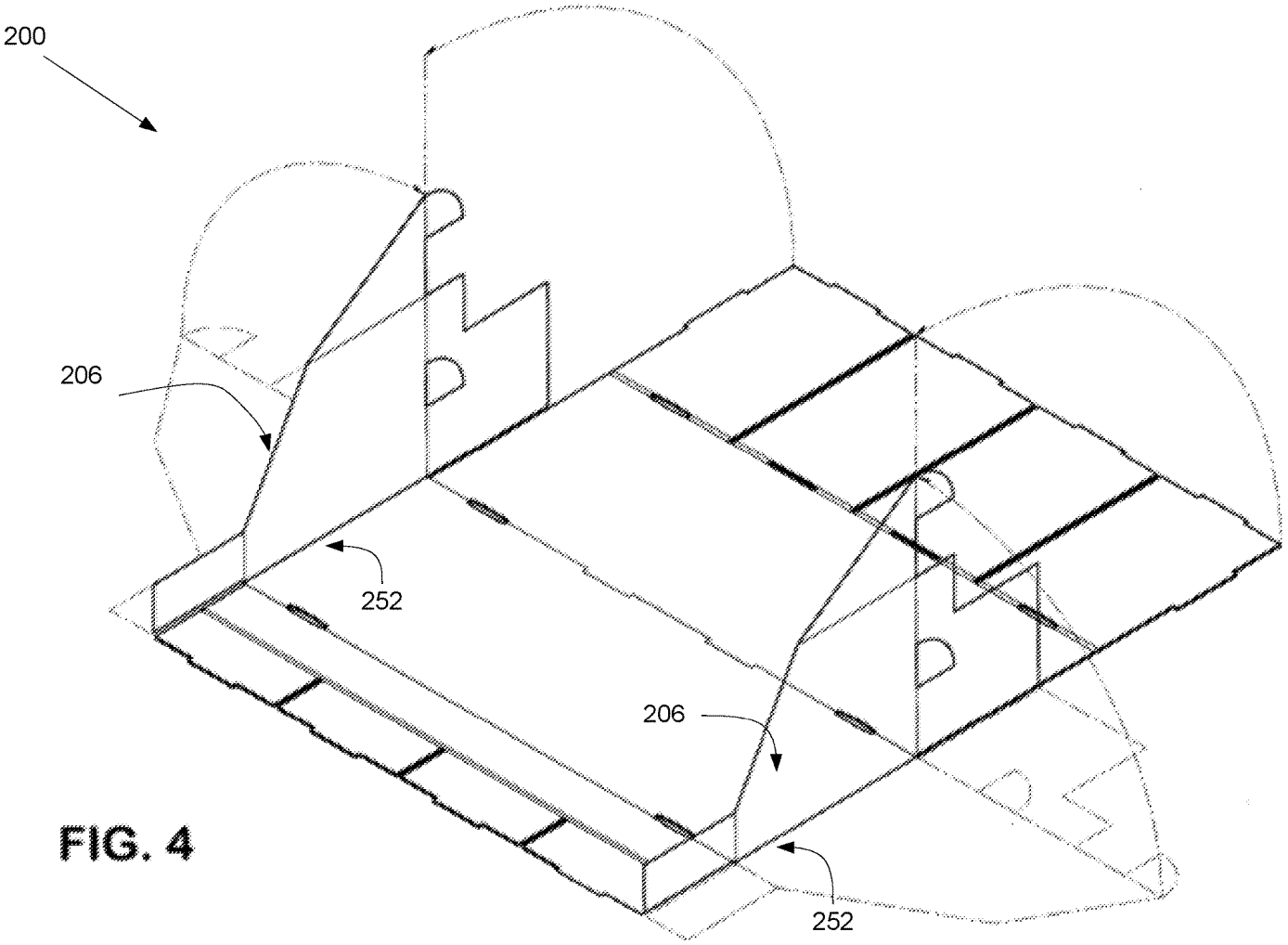
FIGS. 4-8 illustrate the folding of the outer blank of FIG. 3 to form an outer portion of the storage container of FIG. 1 according to various embodiments of the present disclosure.

FIG. 4 illustrates the first step in assembling the box blank 200 into a box. The box blank 200 is folded along the side bottom panel score lines 252 as illustrated to bring the side panels 206 into a vertical position.

Figure 5:
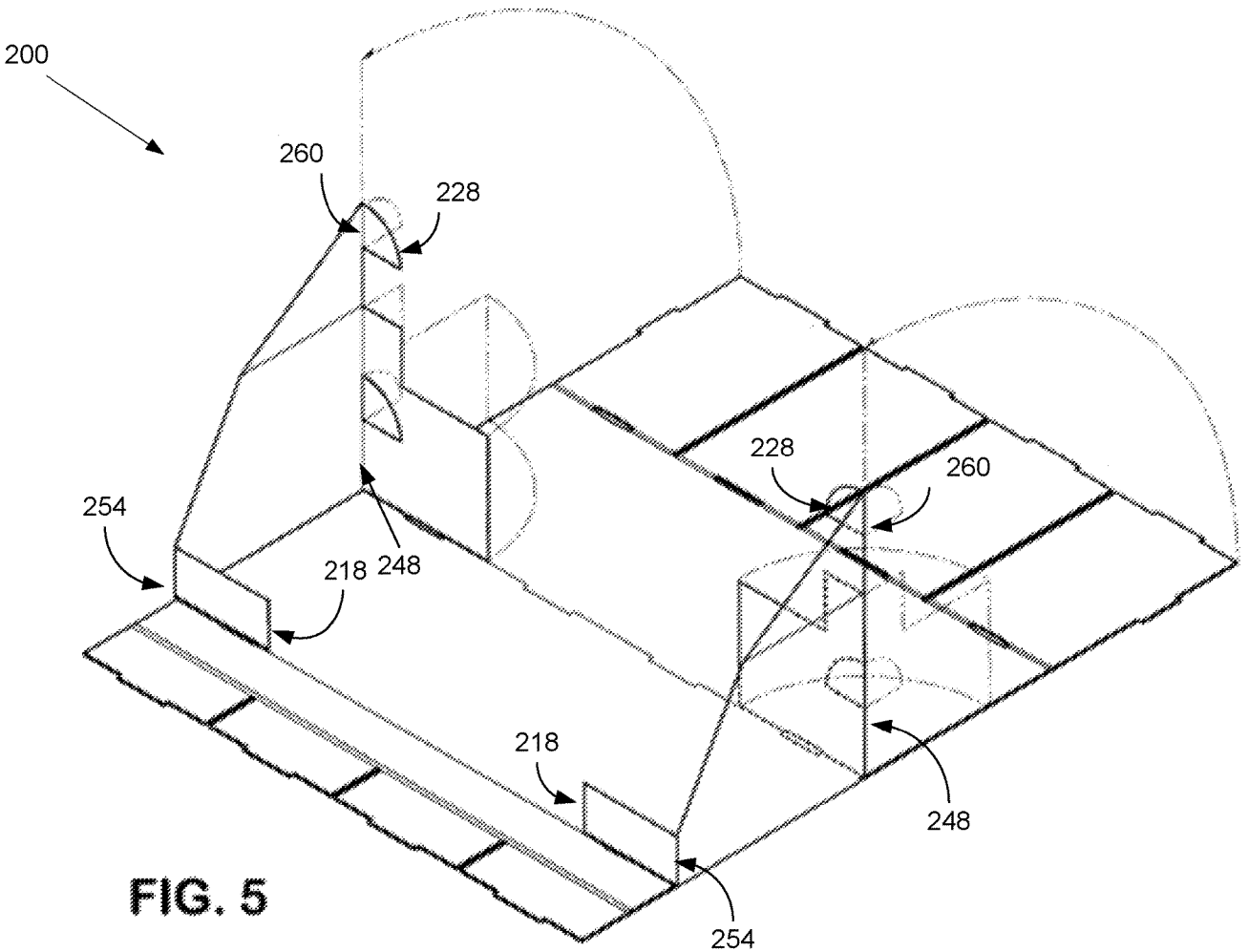

FIG. 5 illustrates the second step in assembling the box blank 200 into a box. The box blank 200 is folded, as illustrated, along the rear side panel score lines 248, the front side panel score lines 254, and the side flap score lines 260. These folds result in the front panel inserts 218 and the quarter-circle tabs 228 being positioned as illustrated.

FIG. 6 illustrates the third step in assembling the box blank 200 into a box. The box blank 200 is folded, as illustrated, along the front bottom panel score line 256 to bring the front panel 208 into a vertical position. The box blank 200 is also folded, as illustrated, along the rear bottom panel score line 246 to bring the back panel 204 into a vertical position.

FIG. 7 illustrates the result of the folds illustrated in FIGS. 4-6.

FIG. 8 illustrates the fourth step in assembling the box blank 200 into a box. The box blank 200 is folded along the back panel score lines 244 in order to fold the outer back panel flaps 220 over the back panel inserts 212 (FIG. 3) such that the rectangular protrusions 234 (FIG. 3) are inserted into the bottom panel apertures 224 (FIG. 3). Similarly, the box blank 200 is also folded along the front panel score lines 258 such that the outer front panel flaps 214 (FIG. 3) are folded over the front panel inserts 218 (FIG. 3) such that the rectangular protrusions 234 extending from the outer front panel flaps 214 are inserted into the bottom panel apertures 224.

Figure 9:
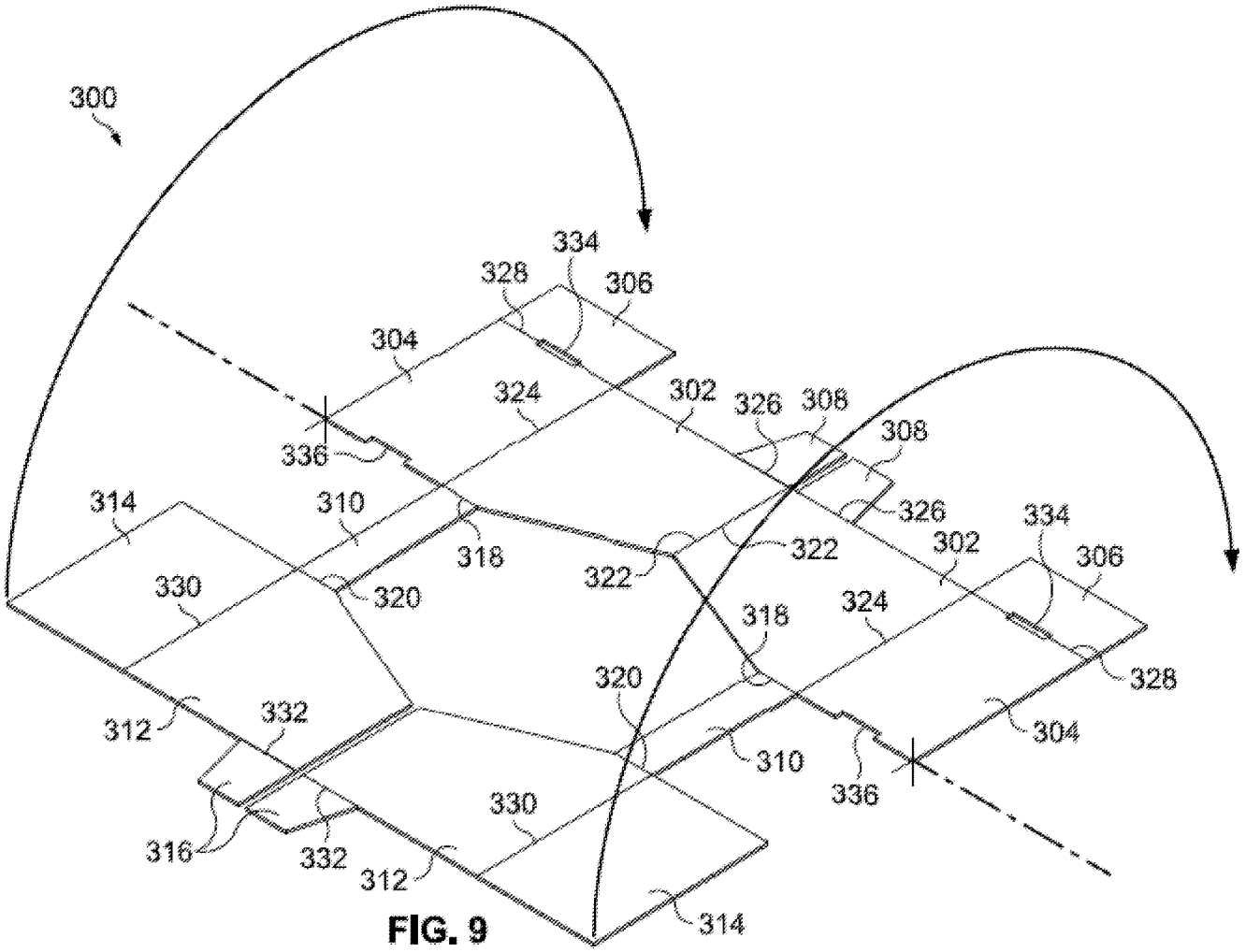
FIG. 9 is a drawing of a top plan view of an inner blank of the storage container of FIG. 1 according to various embodiments of the present disclosure.

FIG. 9 illustrates an example of a divider blank 300 used to assemble a divider that is insertable into the storage container 100 (FIG. 1). The divider blank may include a central partition panel 302 connected to a pair of central partition floors 304. A floor insert 306 may be attached to each of the central partition floors 304. Also, one or more central partition inserts 308 may be attached to the central partition panel 302. Further extending from the central partition panel 302 are panel connectors 310, which connect the central partition panel 302 to the outer partition panels 312. Connected to each outer partition panel 312 is an outer partition floor 314. Also connected to each outer partition panel 312 is an outer partition insert 316.

In some embodiments, the divider blank 300 may also be marked with one or more score lines. The inner panel connector score lines 318, the outer panel connector score lines 320, the central partition panel score line 322, the central partition floor score lines 324, the central partition insert score lines 326, the floor insert score lines 328, the outer partition floor score lines 330, and the outer partition insert score lines 332 generally facilitate folding when assembling the divider blank 300 into a configuration for use as a divider insertable into the storage container 100.

The divider blank 300 may also include a number of slots that may receive projections extending from various portions of the box blank 200 (FIG. 3) to interlock and/or frictionally secure a box assembled from the box blank 200 to a divider assembled from the divider blank 300. For example, the divider blank may include rear slots 334 positioned along the floor insert score lines 328 and front slots 336 positioned along the edge of the central partition floors 304 opposite the floor insert score line 328. Rear rectangular projections 236 (FIG. 3) may be inserted through the rear slots 334 and front rectangular projections 238 (FIG. 3) may be inserted through the front slots 336.

Figure 12:
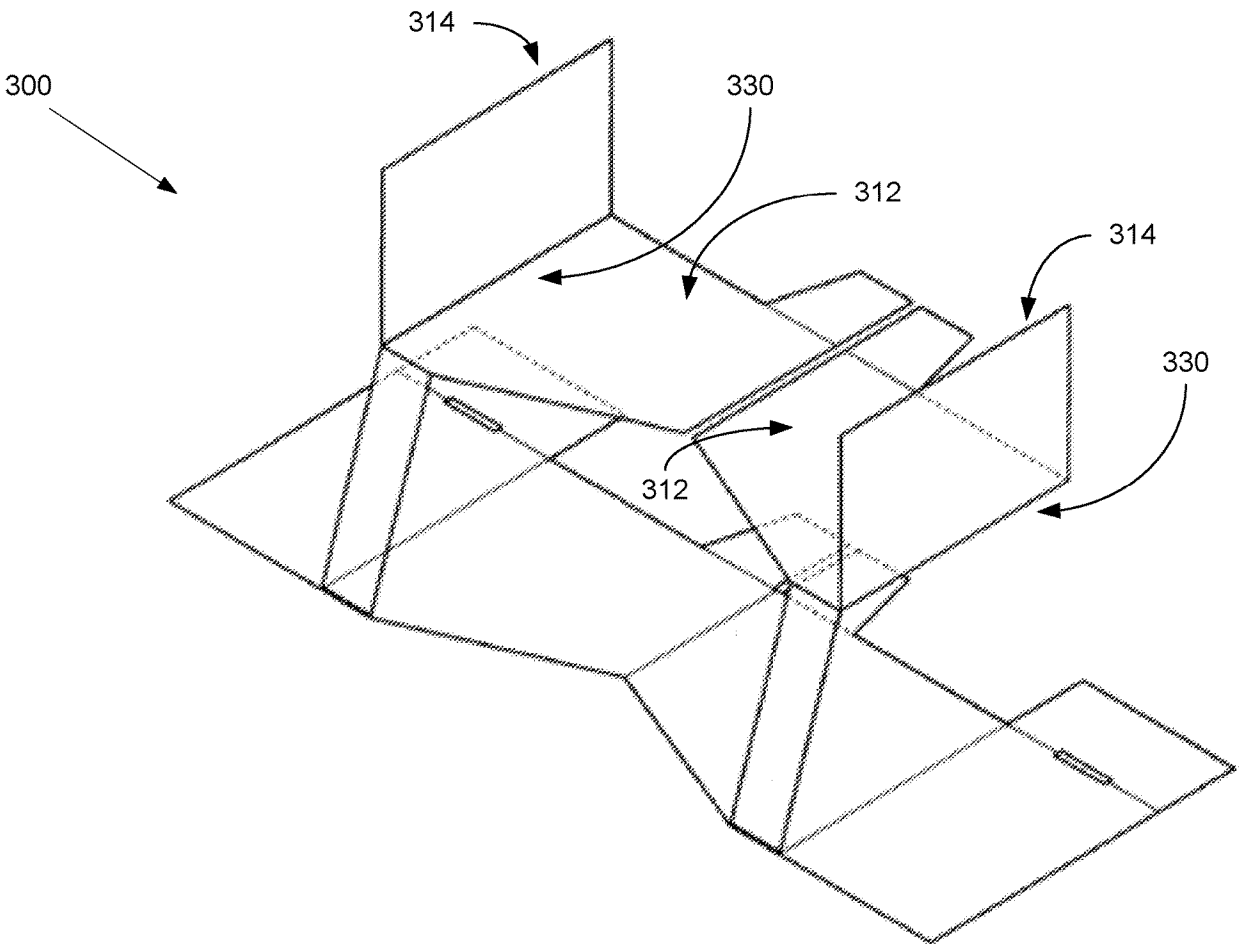
Figure 13:
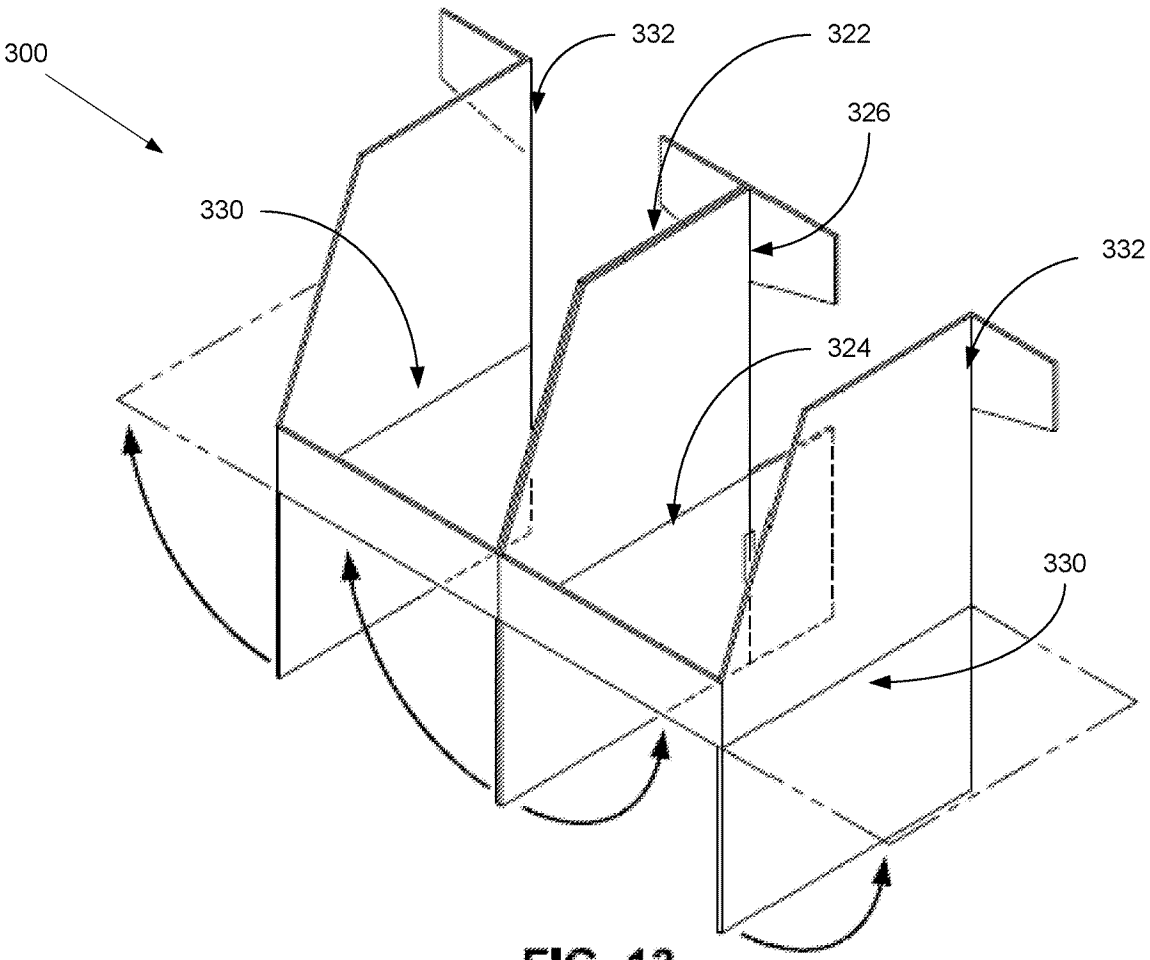
Figure 14:
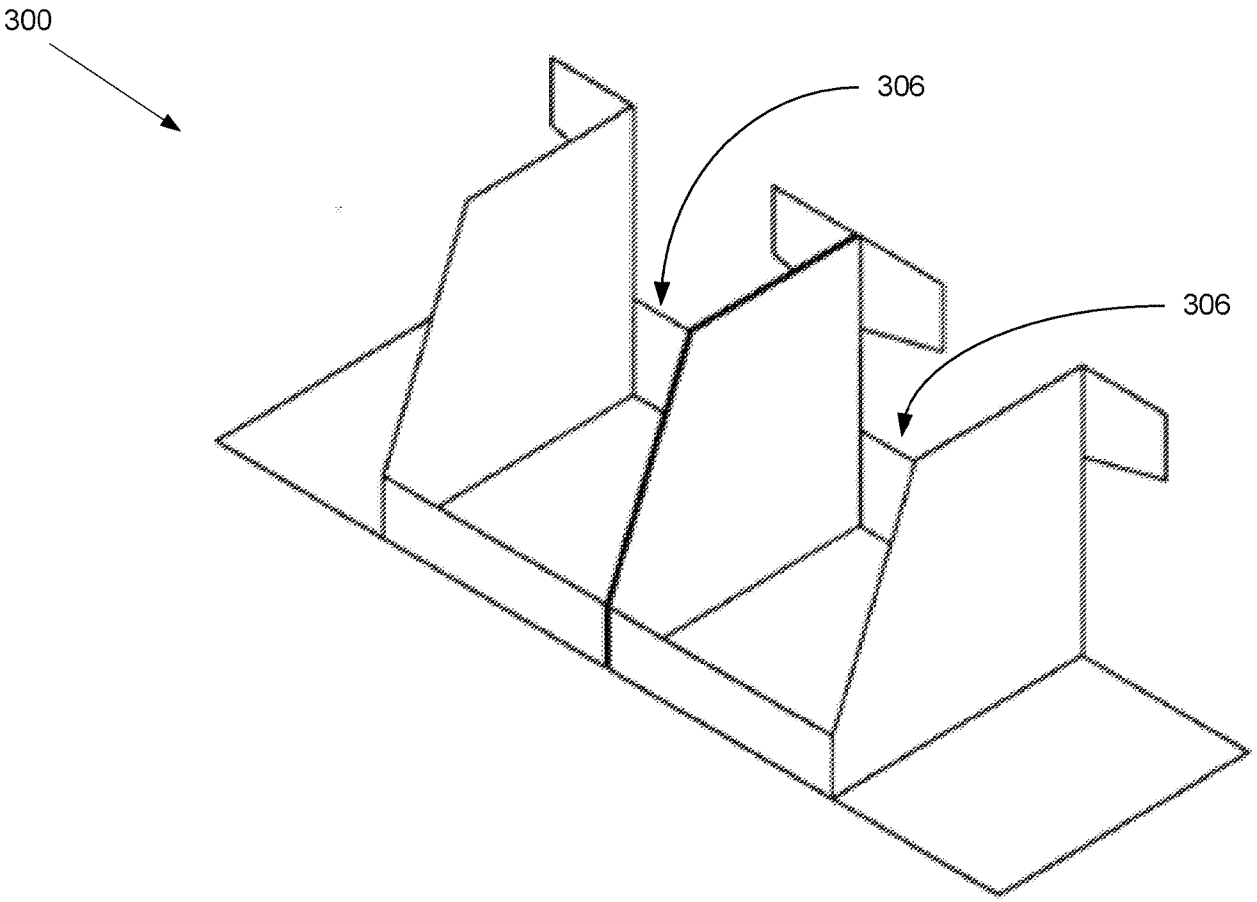

FIGS. 10-13 illustrate the process of folding the divider blank 300 along the various score lines to form a divider as illustrated in FIG. 14. In this configuration the divider blank 300 is assembled into a divider insertable into a partially assembled box folded from the box blank 200 (FIG. 3) prior to subsequently folding the box blank 200 according to the final assembly steps in order to form a storage container 100 (FIG. 1).

Figure 10:
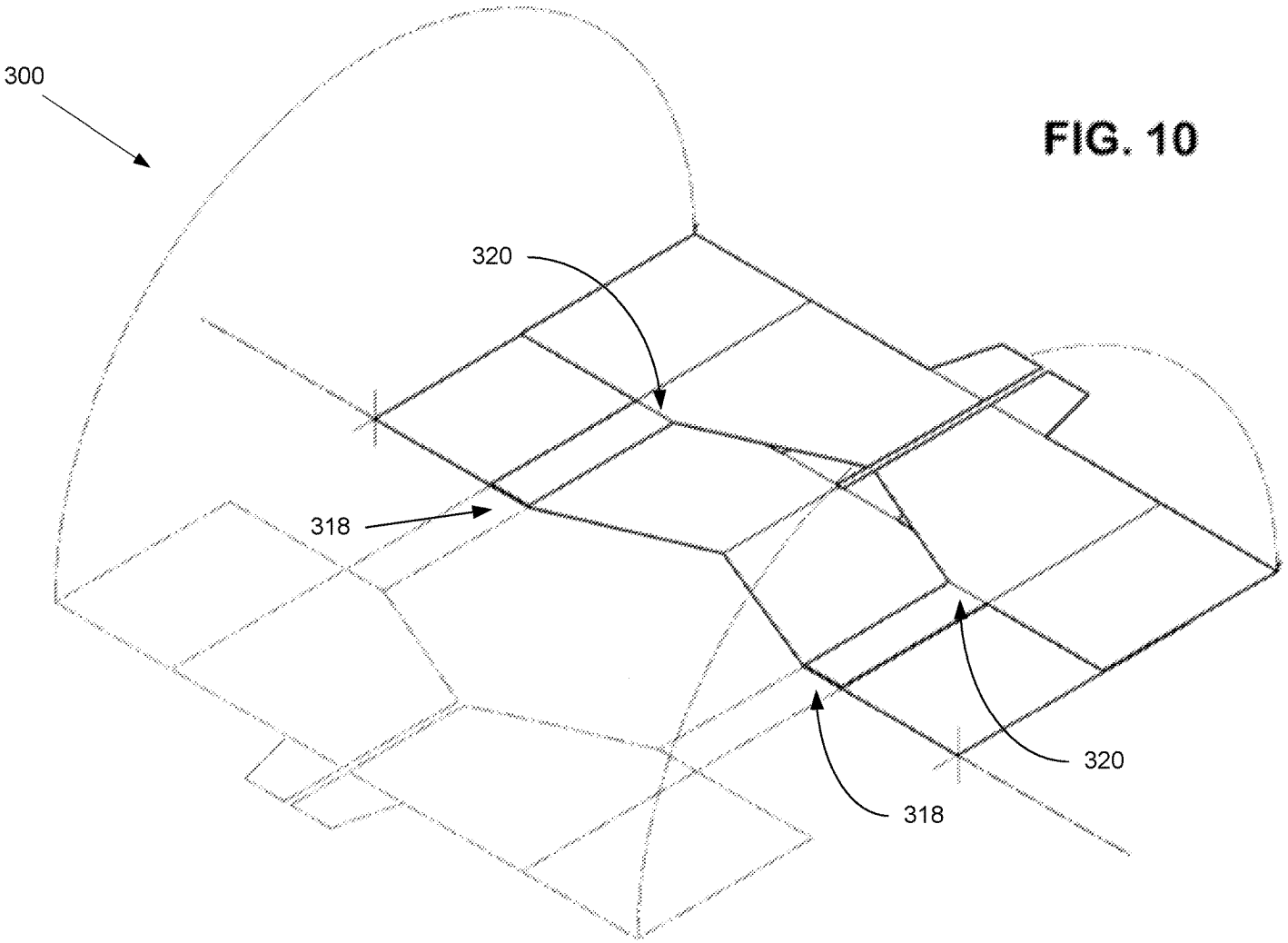
FIGS. 10-14 illustrate the folding of the inner blank of FIG. 9 to form an inner portion of the storage container of FIG. 1 according to various embodiments of the present disclosure.
Figure 11:
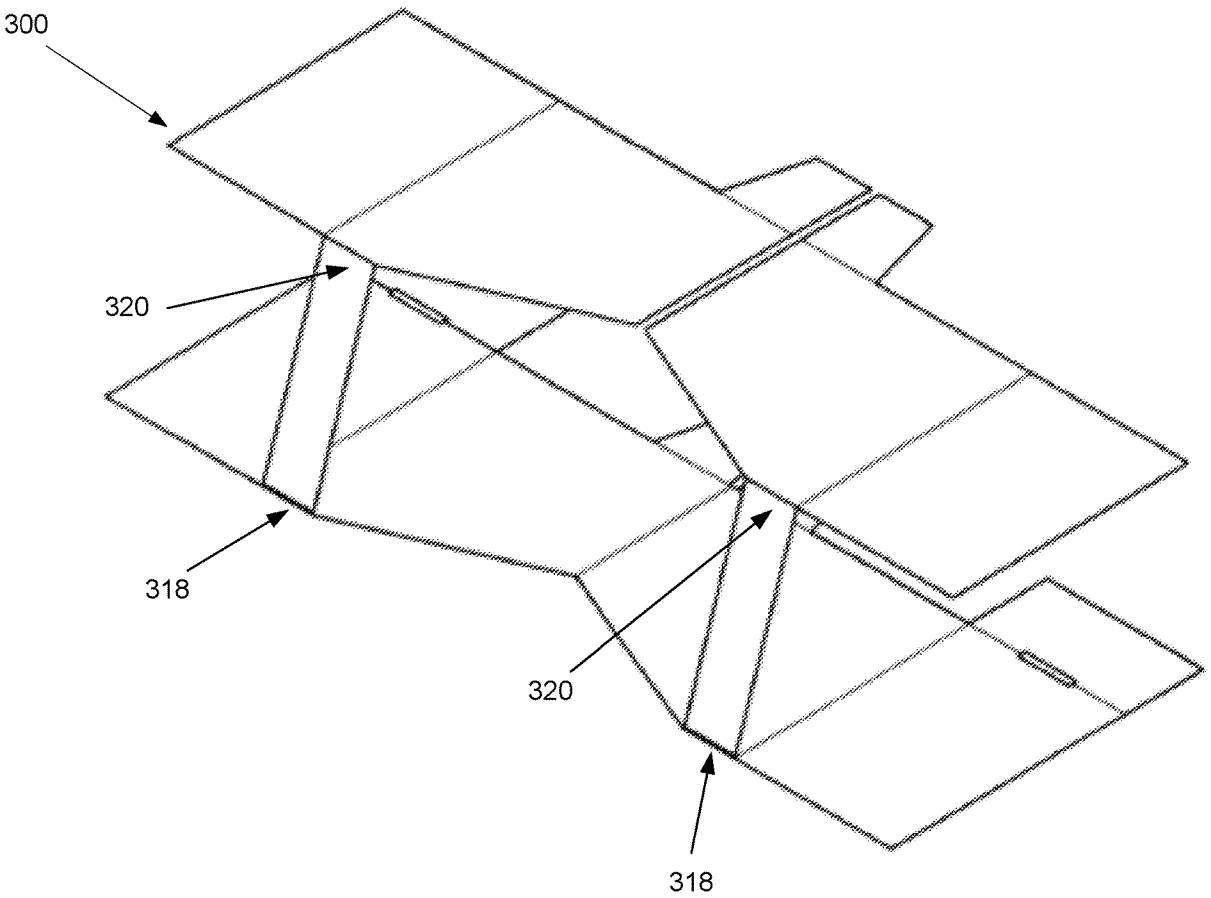

FIG. 10 illustrates the first step in assembling a divider from the divider blank 300. As shown, the divider blank 300 is folded along the inner panel connector score lines 318 and the outer panel connector score lines 320. FIG. 11 illustrates the results of folding the divider blank 300 along the inner panel connector score lines 318 and the outer panel connector score lines 320 as illustrated in FIG. 10 and discussed previously.

FIG. 12 illustrates the second step in assembling the divider from the divider blank 300. As shown, the divider blank 300 is folded along the outer partition floor score lines 330 to position the outer partition floors 314 at a ninety degree angle to the outer partition panels 312.

FIG. 13 illustrates the next steps to assemble the divider from the divider blank 300. In relation to FIG. 12, the divider blank 300 has been folded along the central partition panel score line 322. The divider blank 300 has also been folded along the central partition insert score lines 326 and the outer partition insert score lines 332, positioning the central partition inserts 308 (FIG. 9) and the outer partition inserts 316 (FIG. 9) as illustrated. The divider blank is then folded along the central partition floor score lines 324 and the outer partition floor score lines 330 as shown.

FIG. 14 illustrates the finished divider as assembled from the divider blank 300 according to various embodiments. After folding the divider blank 300 as illustrated in FIG. 13, the divider blank 300 is folded along the floor insert score lines 328 (FIG. 9) to place the floor inserts 306 in their final position.

Figure 15:
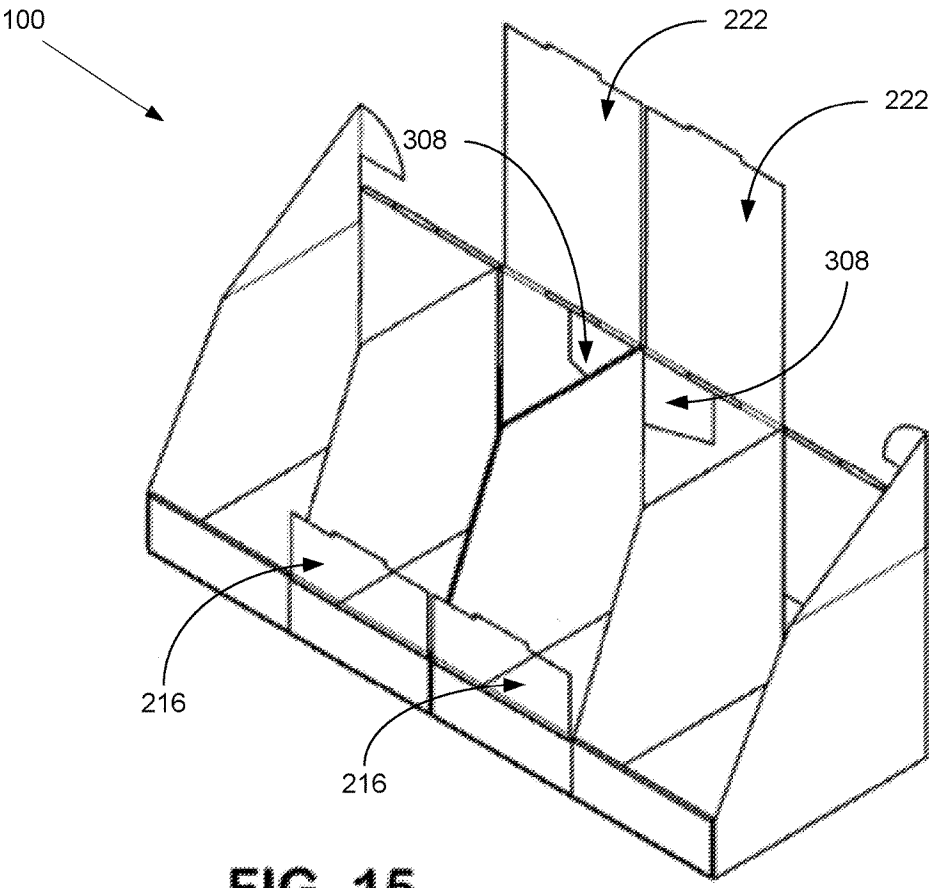
FIGS. 15-16 illustrate the insertion of the folded inner blank of FIG. 14 into the partially folded outer blank of FIG. 8 and subsequent folding of the outer blank to form the storage container of FIG. 1 according to various embodiments of the present disclosure.
Figure 16:
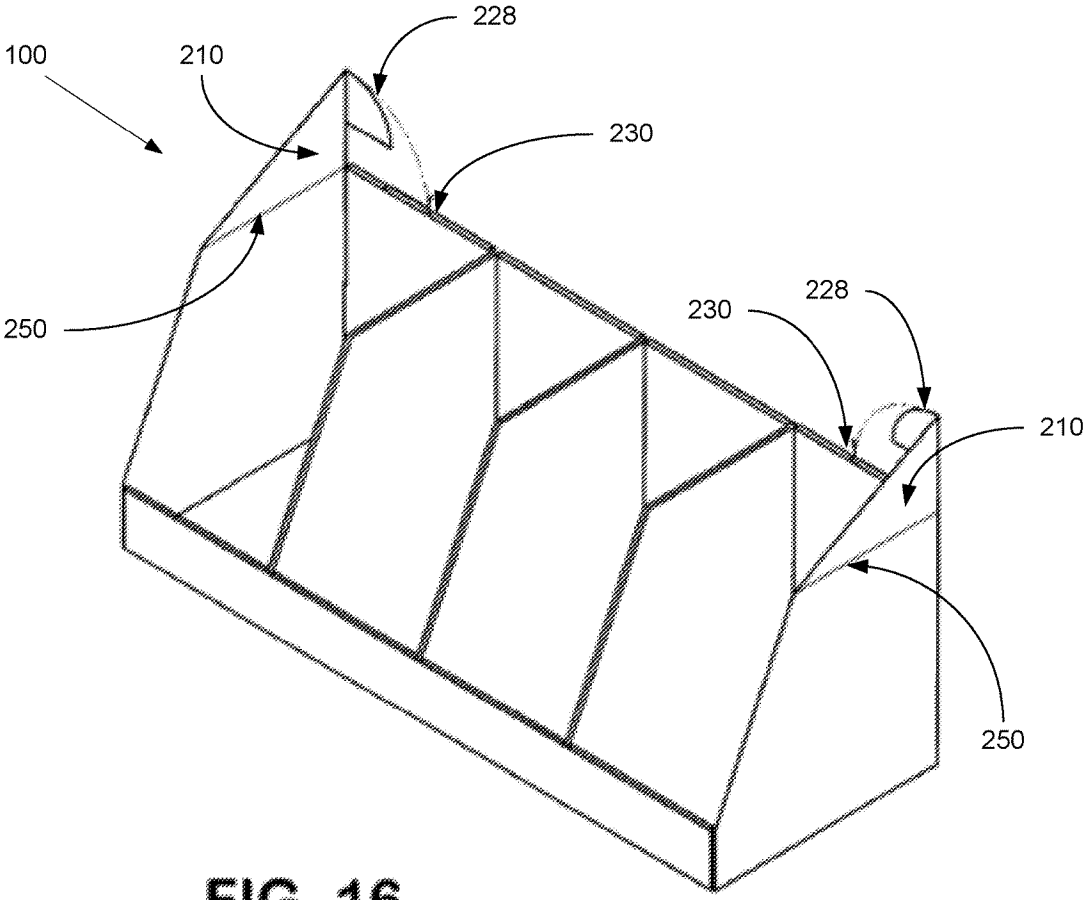

FIGS. 15-16 illustrate the process of inserting folded divider blank 300 of FIG. 14 into the partially folded box blank 200 of FIG. 8 and subsequently folding box blank 200 to form the storage container 100 of FIG. 1. As shown, after insertion of the folded divider blank 300 into the partially folded box blank 200, the inner back panel flaps 222 are folded along the back panel score lines 244 (FIG. 3) so that they cover the central partition inserts 308 and the outer back panel flaps 220 (FIG. 3) are folded along the back panel score lines 244 so that they cover the outer partition inserts 316 (FIG. 9). The inner front panel flaps 216 may also be folded over the panel connectors 310 (FIG. 9) to assemble the storage container 100. In some embodiments, the side flaps 210 may be folded along the top side panel score lines 250 such that the quarter-circle tabs 228 are inserted into the top panel apertures 230.

Other variations consistent with the embodiments described herein are possible and within the scope of the claims as provided below. For example, the positioning of the rectangular tabs 226 (FIG. 3) and the rectangular slots 232 (FIG. 3) may be switched. In such embodiments, the rectangular tabs 226 of a first storage container 100 may be inserted upwards into the rectangular slots 232 of another storage container to interlock two storage containers 100. Such an embodiment is illustrated in FIG. 18.

Figure 17A:
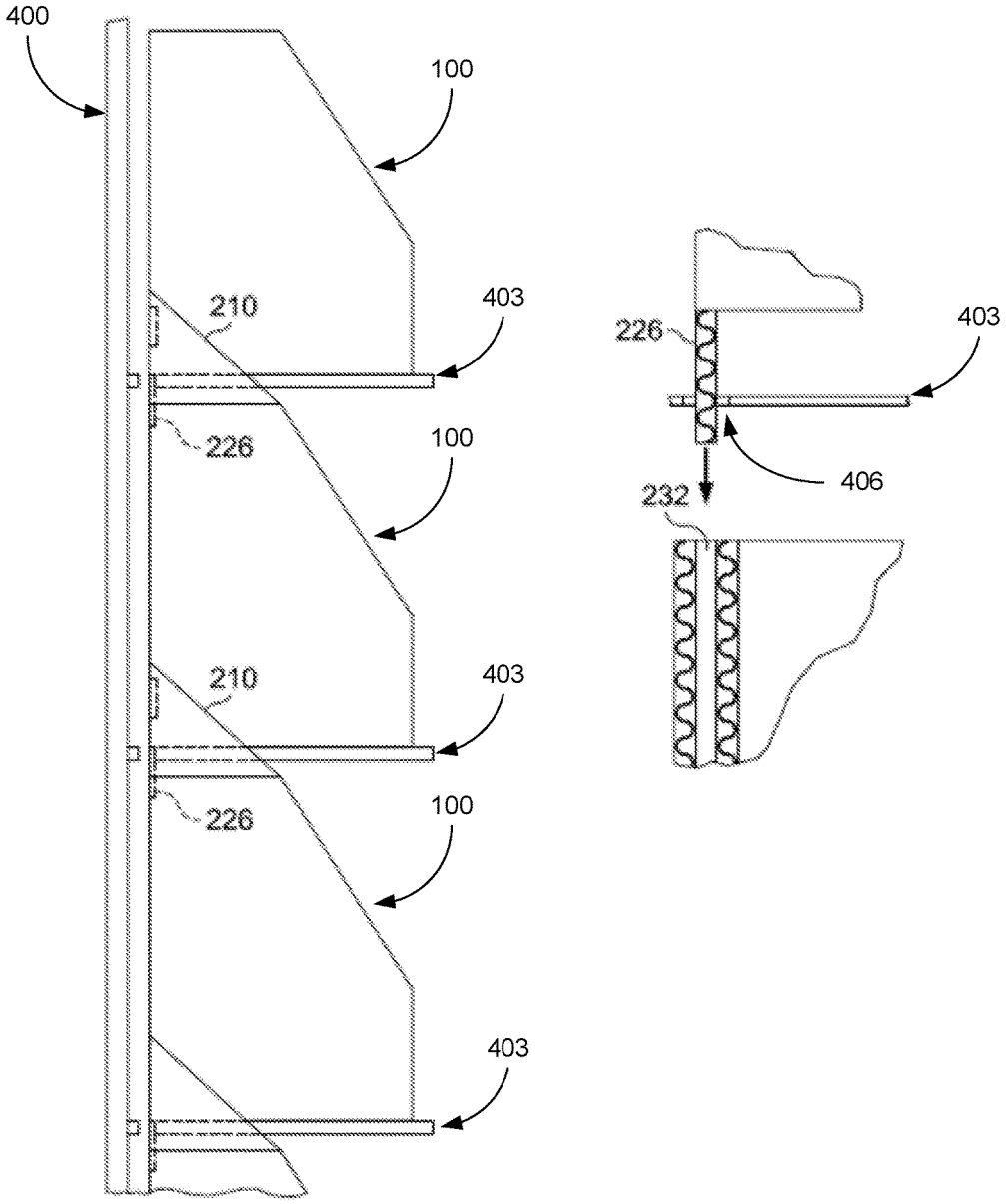
FIG. 17A is a drawing illustrating a stacking arrangement of storage containers according to various embodiments of the present disclosure.

FIG. 17A illustrates a storage assembly using an embodiment of one or more storage containers 100. A shelving system 400 is depicted. The shelving system may include one or more shelves 403. Each shelf 403 may hold one or more storage containers 100. Each shelf 403 may include one or more holes 406. Rectangular tabs 226 of individual storage containers 100 may be inserted downwards through the holes 406. In some embodiments, the rectangular tabs 226 may be inserted into the rectangular slots 232 of other storage containers 100 to connect multiple storage containers together and interlock the storage containers 100 with the shelf 403. In some embodiments, the storage containers 100 may be further joined together by having the side flaps 210 of a lower storage container 100 fold up such that the quarter-circle tabs 228 (FIG. 2) of the lower storage container are inserted into the quarter-circle slots 242 (FIG. 2) of the upper storage container 100.

Figure 17B:
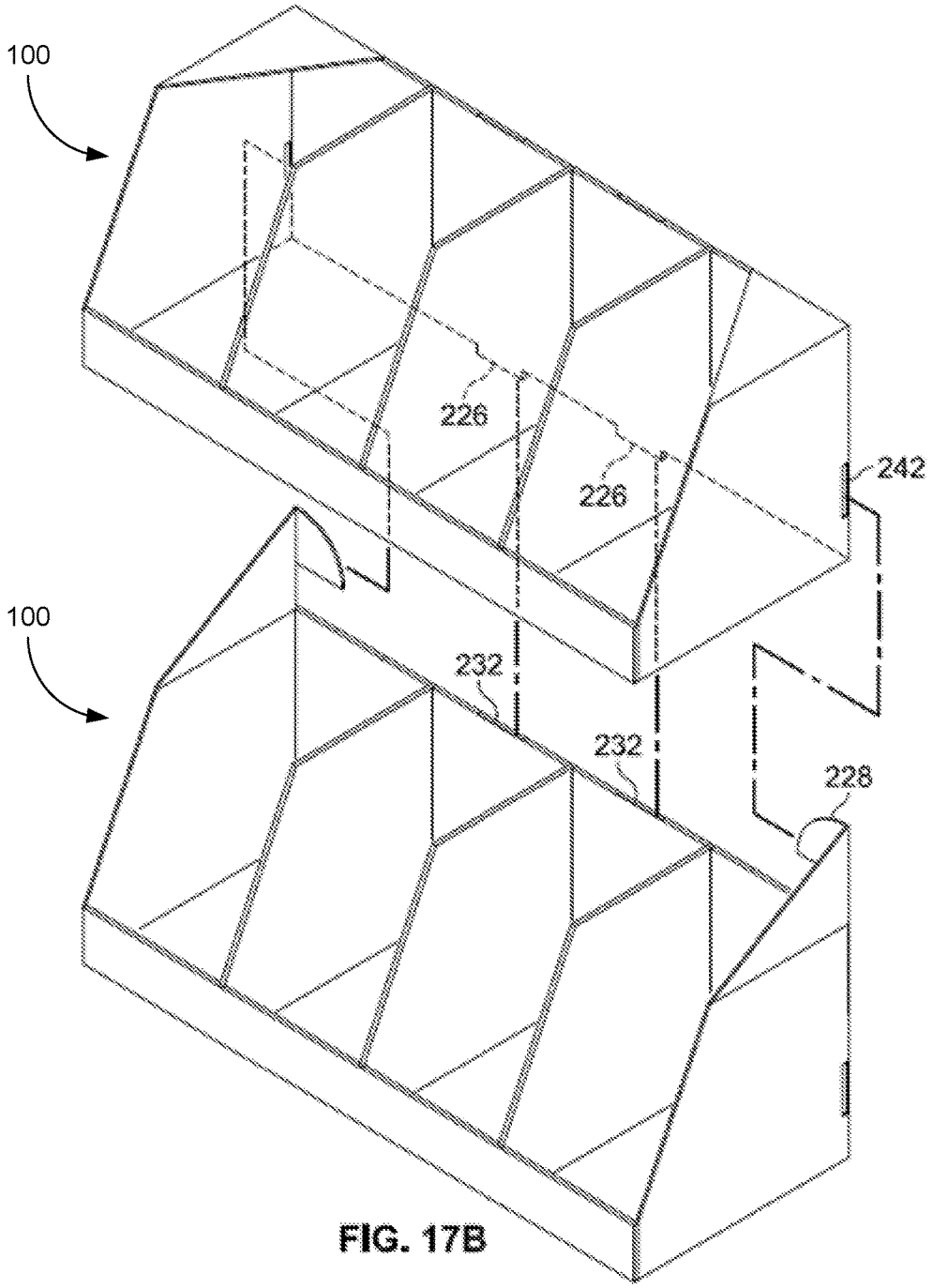
FIG. 17B is a drawing further illustrating the stacking mechanisms of storage containers according to various embodiments of the present disclosure.

FIG. 17B further illustrates the interconnection of the storage containers 100 depicted in FIG. 17A. Here, the quarter-circle tabs 228 of the lower storage container 100 are shown as being inserted into the quarter-circle slots 242 of the upper storage container 100. Further, the rectangular tabs 226 of the upper storage container 100 are shown as being inserted into the rectangular slots 232 of the lower storage container 100.

Figure 18:
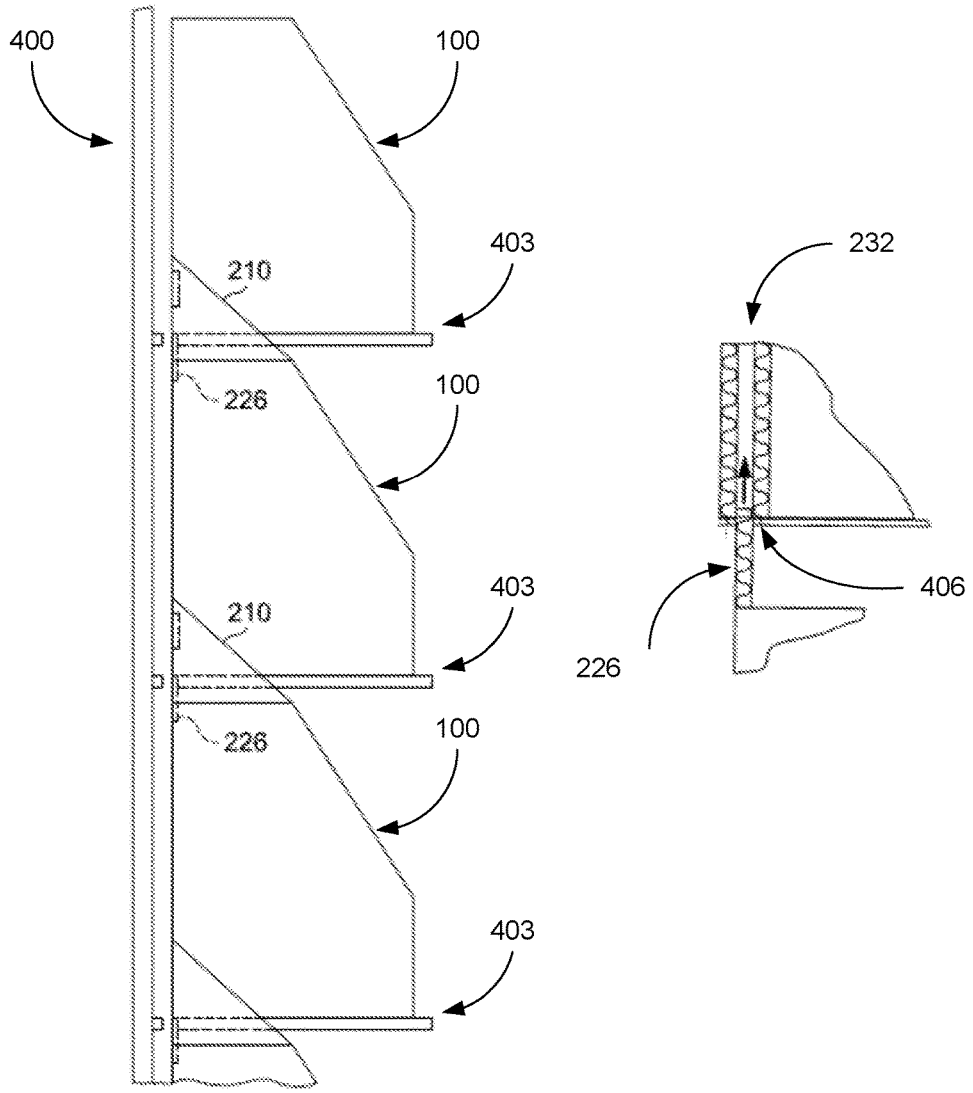
FIG. 18 is a drawing illustrating a stacking arrangement of storage containers according to various embodiments of the present disclosure.

FIG. 18 illustrates a storage assembly using another embodiment of one or more storage containers 100. A shelving system 400 is depicted. The shelving system may include one or more shelves 403. Each shelf 403 may hold one or more storage containers 100. Each shelf 403 may include one or more holes 406. In contrast to the embodiment depicted in FIG. 17A, the rectangular tabs 226 of individual storage containers 100 may be inserted upwards through the holes 406. In some embodiments, the rectangular tabs 226 may be inserted into the rectangular slots 232 of other storage containers 100 to connect multiple storage containers together and interlock the storage containers 100 with the shelf 403. In some embodiments, the storage containers 100 may be further joined together by having the side flaps 210 of a lower storage container 100 fold up such that the quarter-circle tabs 228 (FIG. 2) of the lower storage container are inserted into the quarter-circle slots 242 (FIG. 2) of the upper storage container 100 in the manner previously depicted in FIG. 17B.

Figure 19:
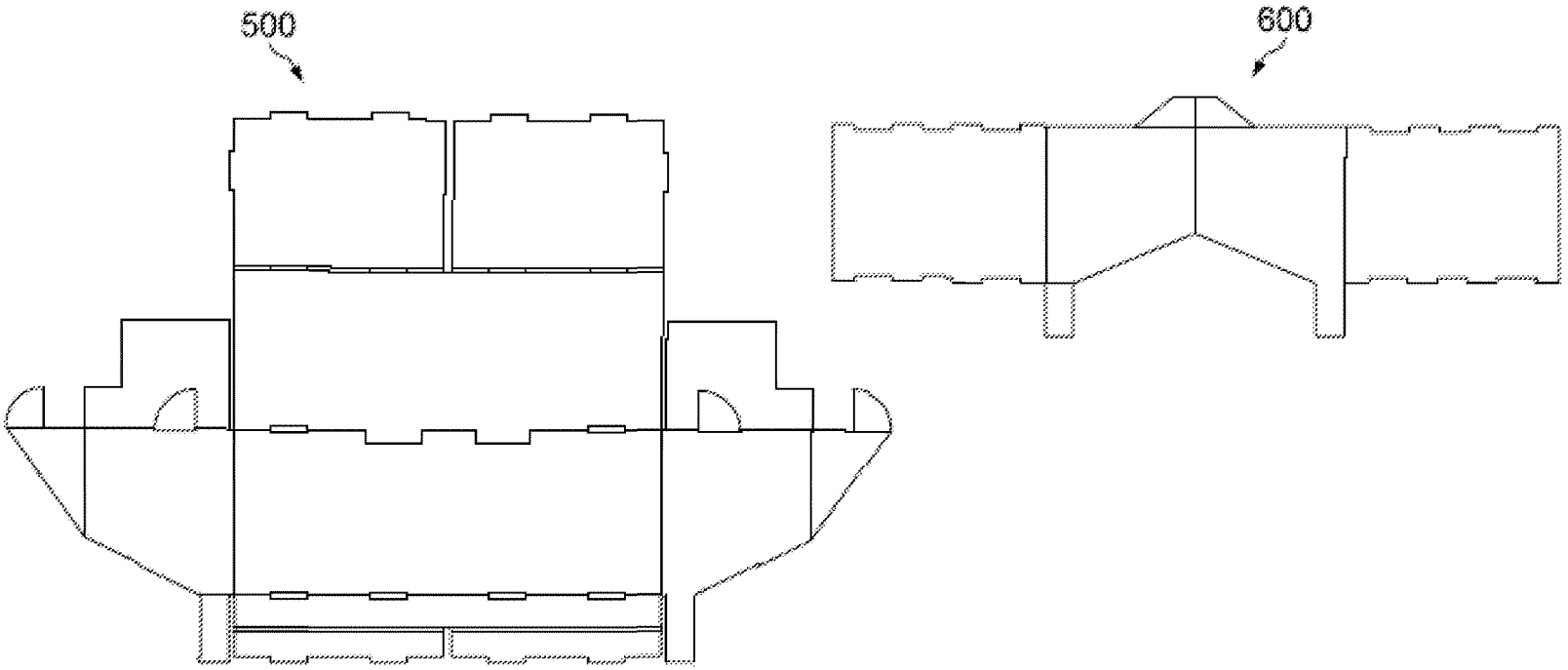
FIG. 19 is a view of an outer blank and an inner blank of a storage container according to various embodiments of the present disclosure.

FIG. 19 illustrates a container blank 500 and a divider blank 600 of an alternative embodiment of the storage container 100 (FIG. 1) wherein the interior of the storage container is divided by a single partition. The alternate embodiment may be used with the storage assembly depicted in FIGS. 17A, 17B, and 18. Further, the alternate embodiment may be used in the storage assembly depicted in FIGS. 17A, 17B, and 18 in conjunction with the previously described embodiments of the storage container 100 (FIG. 1).

Figure 20:
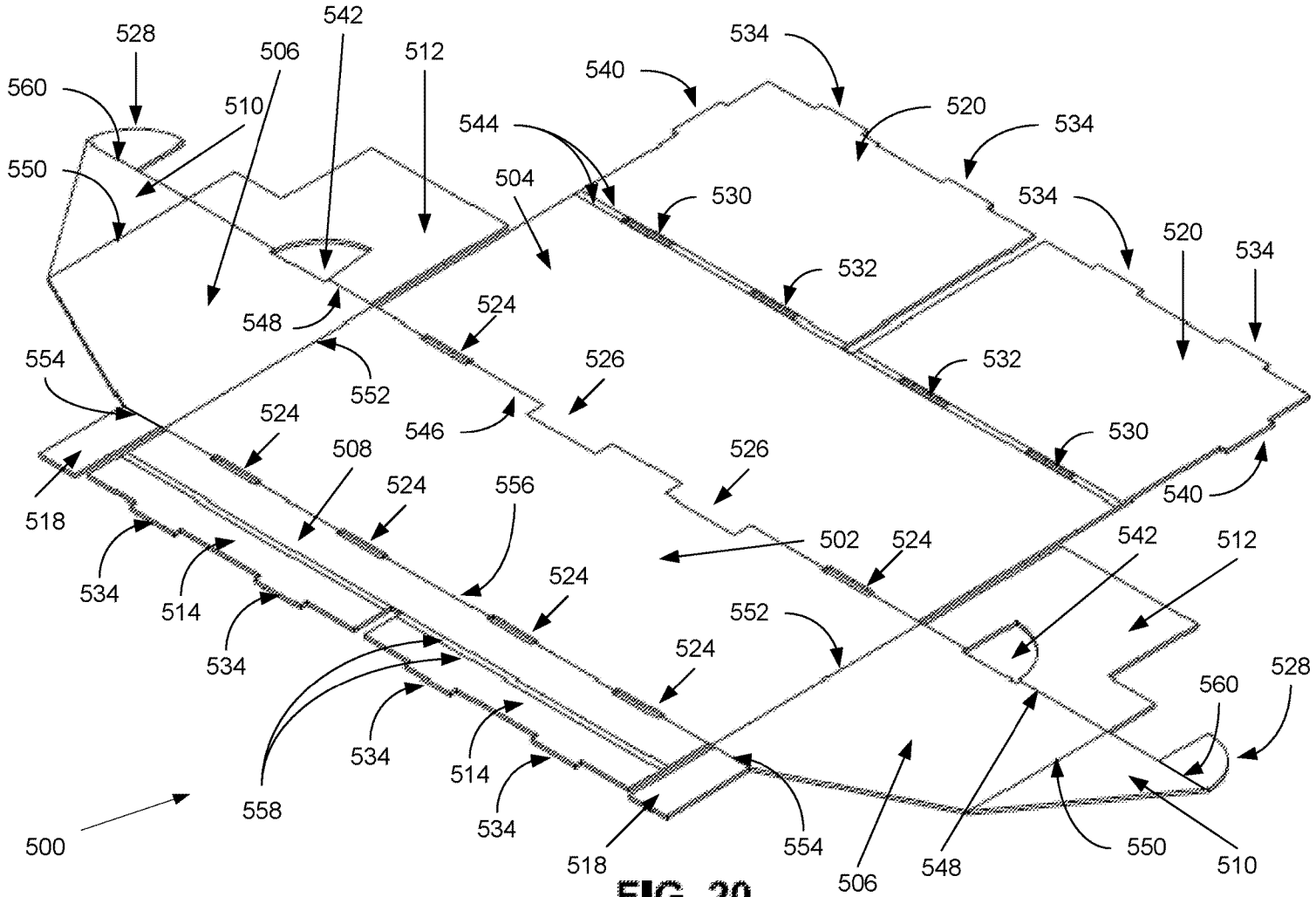
FIG. 20 is a drawing of a top plan view of the outer blank of FIG. 19 according to various embodiments of the present disclosure.

FIG. 20 illustrates an example of a container blank 500 used to assemble an alternative embodiment of the storage container 100 (FIG. 1). The container blank 500 is composed of a bottom panel 502 that is connected to a back panel 504, two side panels 506, and a front panel 508. Extending from the back panel 504, side panels 506, and the front panel 508 are various inserts, flaps, tabs, flanges and protrusions which connect to various apertures and slots as will be described herein.

Extending from the top of each side panel 506 is a side flap 510. In some embodiments, the side flap 510 may be triangularly shaped although various embodiments may make use of other shapes, such as squares, wedges, portions of circles, and other such shapes. Extending from the rear edge of each side panel 506 is a back panel insert 512.

Extending from the front panel 508 are a plurality of front panel flaps 514. The front panel flaps 514 may be folded over front panel inserts 518 extending from a forward edge of the side panels 506, securing the front panel inserts 518 between the front panel flaps 514 and the front panel 508.

Extending from the back panel 504 are a plurality of back panel flaps 520. The back panel flaps 520 may be folded over the back panel inserts 512 extending from the rear edge of each side panel 506, securing the back panel inserts 512 between the back panel flaps 520 and the back panel 504.

The bottom panel 502 includes a number of apertures and tabs. For example, various protrusions extending from the front panel flaps 514 and back panel flaps 520 may be inserted into the bottom panel apertures 524 to frictionally secure the front panel flaps 514 and back panel flaps 520 to the bottom panel 502. The bottom panel 502 may also include one or more rectangular tabs 526 that are used to interlock with other storage containers 100.

Some embodiments may also include a pie-shaped, wedge shaped, or arcing tab. For example, a quarter-circle tab 528 may extend from the side flaps 510. In such embodiments, the quarter-circle tab 528 may be positioned such that one end of the arcing edge terminates at the far corner, edge, or end from the side panel 506. In embodiments where the side flap 510 is triangularly shaped, this corner is end of the hypotenuse of the side flap 510 opposite the side panel 506. In embodiments that include the quarter-circle tab 528, the side flap 510 may be folded such that the quarter-circle tab 528 may be inserted into one of the top panel apertures 530, securing the quarter circle tab 528 between the back panel flap 520 and the back panel 504.

Some embodiments may include one or more rectangular slots 532 located between the back panel flaps 520 and the back panel 504. These rectangular slots 532 may receive rectangular tabs 526 positioned along the bottom panel 502 of another storage container 100, interlocking two storage containers 100 with each other. In various embodiments, the positions of the rectangular tabs 526 and the rectangular slots 532 may be switched, permitting rectangular tabs 526 to be inserted from underneath instead of above, as previously described.

The front panel flaps 514 and the back panel flaps 520 may have rectangular protrusions 534 extending from the side opposite the front panel 508 or the back panel 504, as illustrated. These rectangular protrusions 534 may be inserted into the bottom panel apertures 524 as previously described to frictionally secure the front panel flaps 514 and back panel flaps 520 to the bottom panel 502 while securing the front panel inserts 518 between the front panel flaps 514 and the front panel 508 and the back panel inserts 512 between the back panel flaps 520 and the back panel 504. Some of the rectangular protrusions 534 may further pass through slots of the divider assembled from the divider blank 600 (FIG. 19), as will be further described herein, in order secure the assembled divider to the assembled container.

In some embodiments, the back panel flaps 520 may have a flange 540 protruding from the exterior side of the back panel flaps 520. The flange 540 may be insertable into a quarter-circle slot 542 located within the back panel insert 512 along the edge of the side panel 506, securing the back panel flap 520 to the side panel 506 and the back panel insert 512. In some embodiments, the quarter-circle slot 542 may also receive a quarter-circle tab 528 of another storage container 100 beneath the storage container 100, interlocking two storage containers 100.

In some embodiments, the container blank 500 may also be marked with one or more score lines. The back panel score lines 544, the rear bottom panel score lines 546, the rear side panel score lines 548, the top side panel score lines 550, the side bottom panel score lines 552, the front side panel score lines 554, the front bottom panel score lines 556, the front panel score lines 558, and the side flap score lines 560 generally facilitate folding when assembling the container blank 500 into the storage container 100.

FIGS. 21-25 illustrate the process of folding the container blank 500 to assemble a storage container 100 (FIG. 1).

Figure 21:
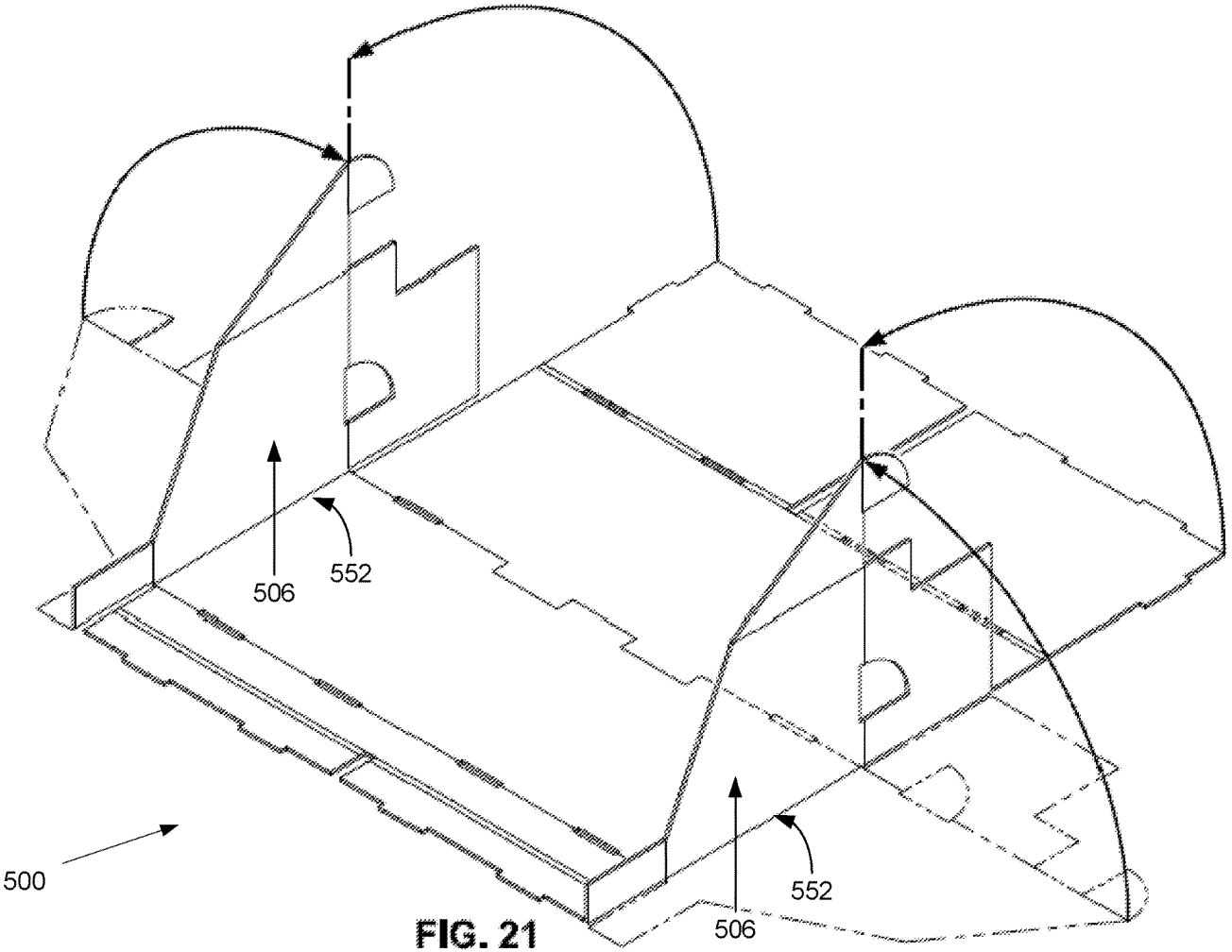
FIGS. 21-25 illustrate the folding of the outer blank of FIG. 20 to form an outer portion of an embodiment of the storage container of FIG. 1.

FIG. 21 illustrates the first step in folding the container blank 500. The container blank 500 is folded along the side bottom panel score lines 552 as illustrated to bring the side panels 506 into a vertical position.

Figure 22:
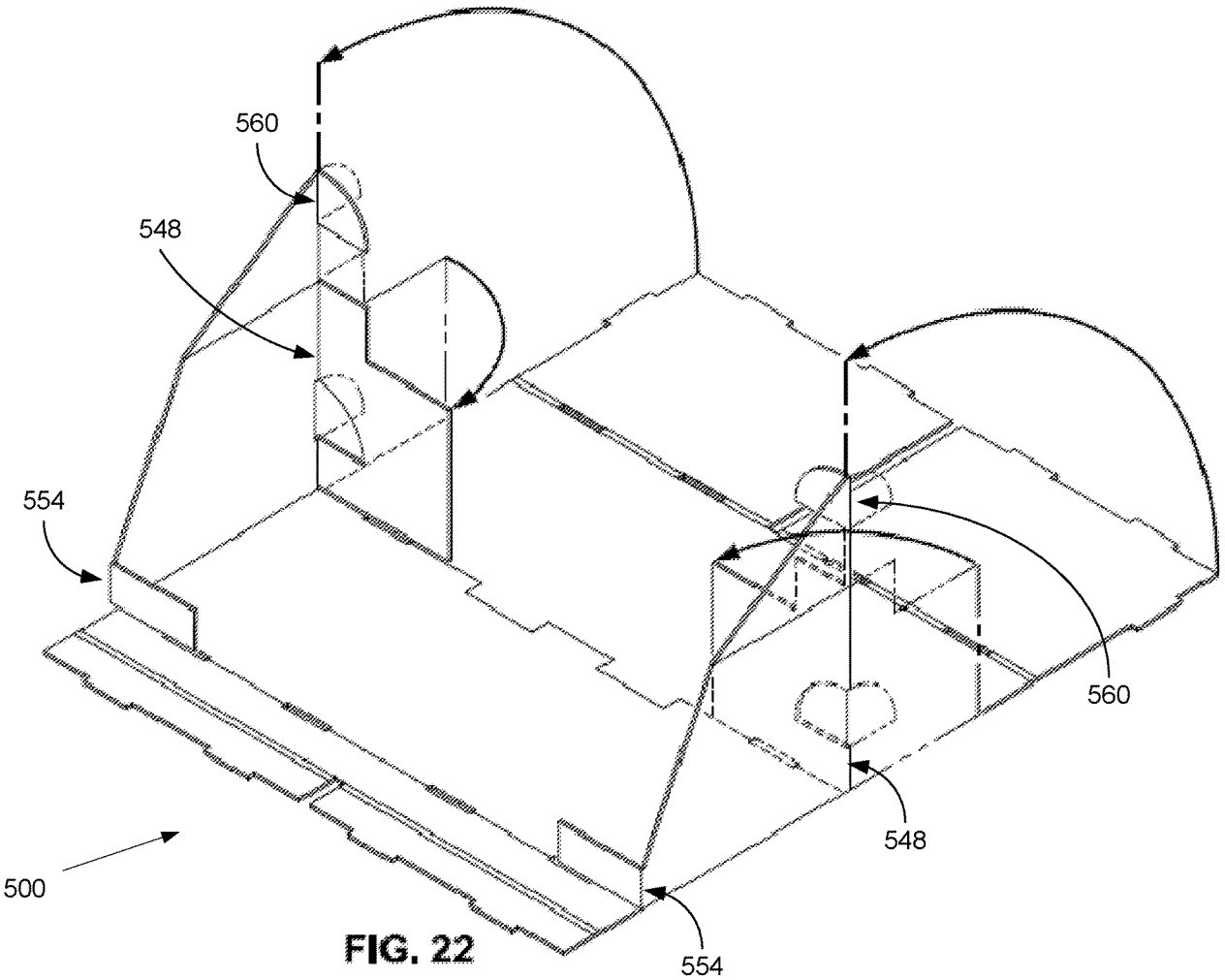

FIG. 22 illustrates the second step in folding the container blank 500. The container blank 500 is folded, as illustrated, along the rear side panel score lines 548, the front side panel score lines 554, and the side flap score lines 560.

Figure 23:
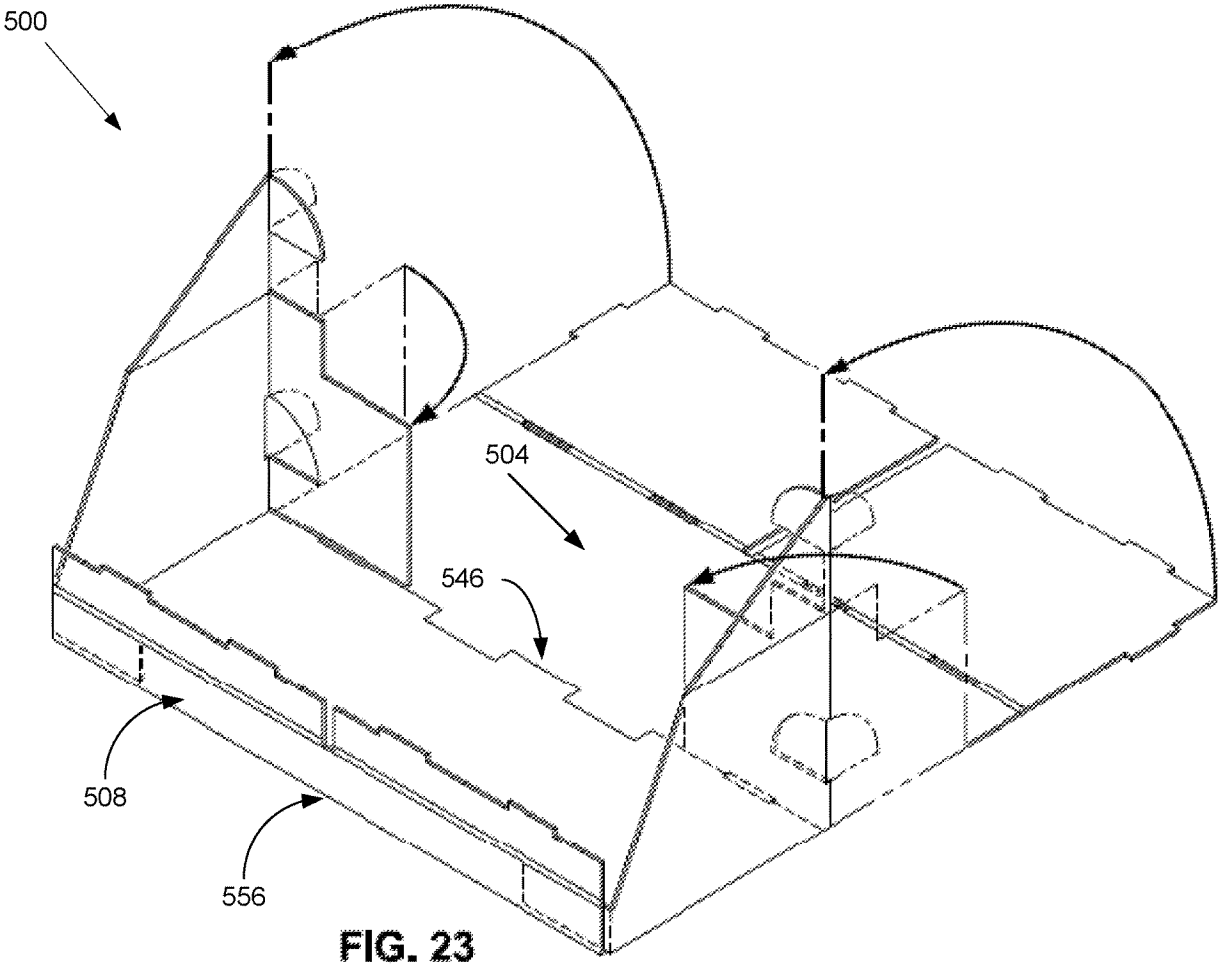

FIG. 23 illustrates the third step in folding the container blank 500. The container blank 500 is folded, as illustrated, along the front bottom panel score line 556 to bring the front panel 508 into a vertical position. The container blank is also folded along the rear bottom panel score line 546 to bring the back panel 504 into a vertical position.

Figure 24:
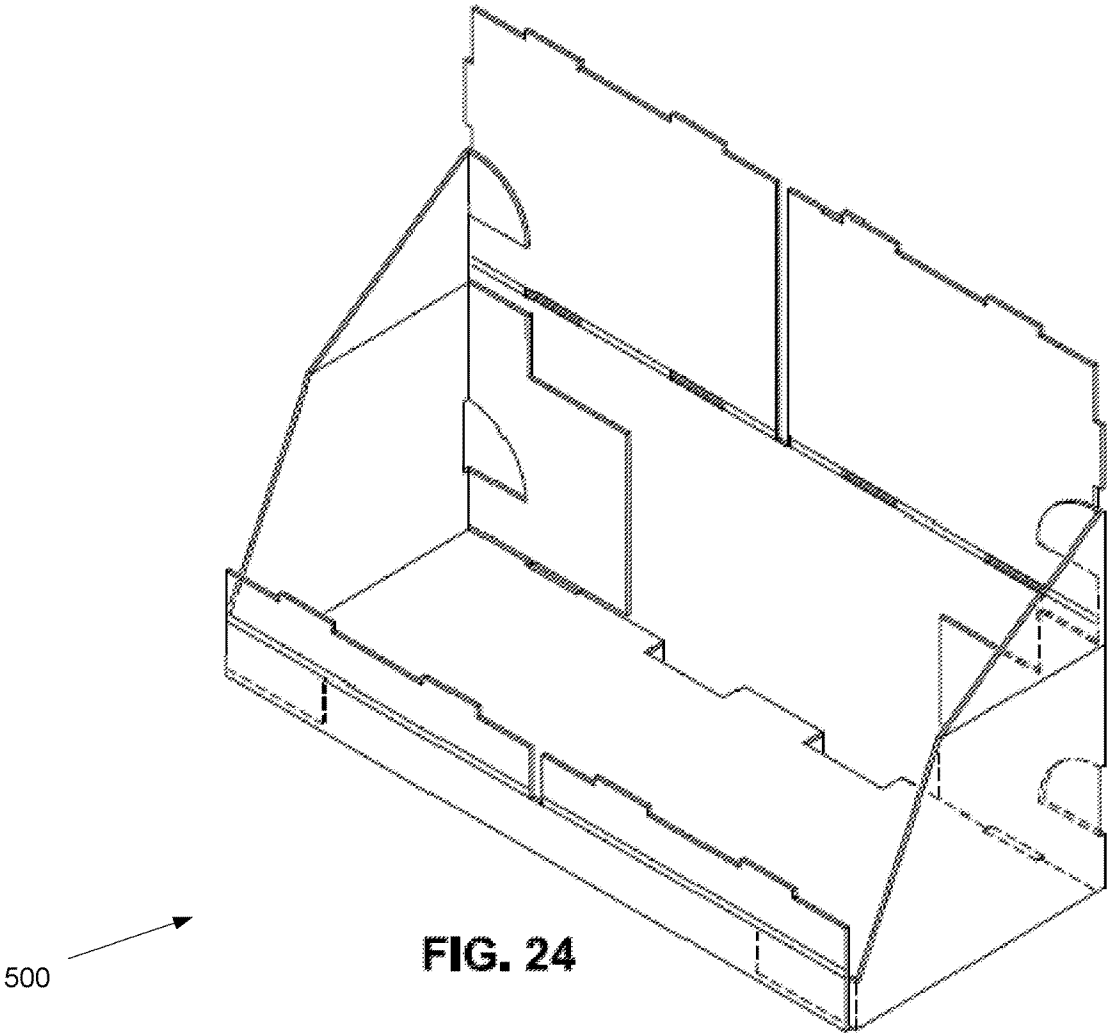

FIG. 24 illustrates the result of the foldings depicted in FIGS. 21-23.

Figure 25:
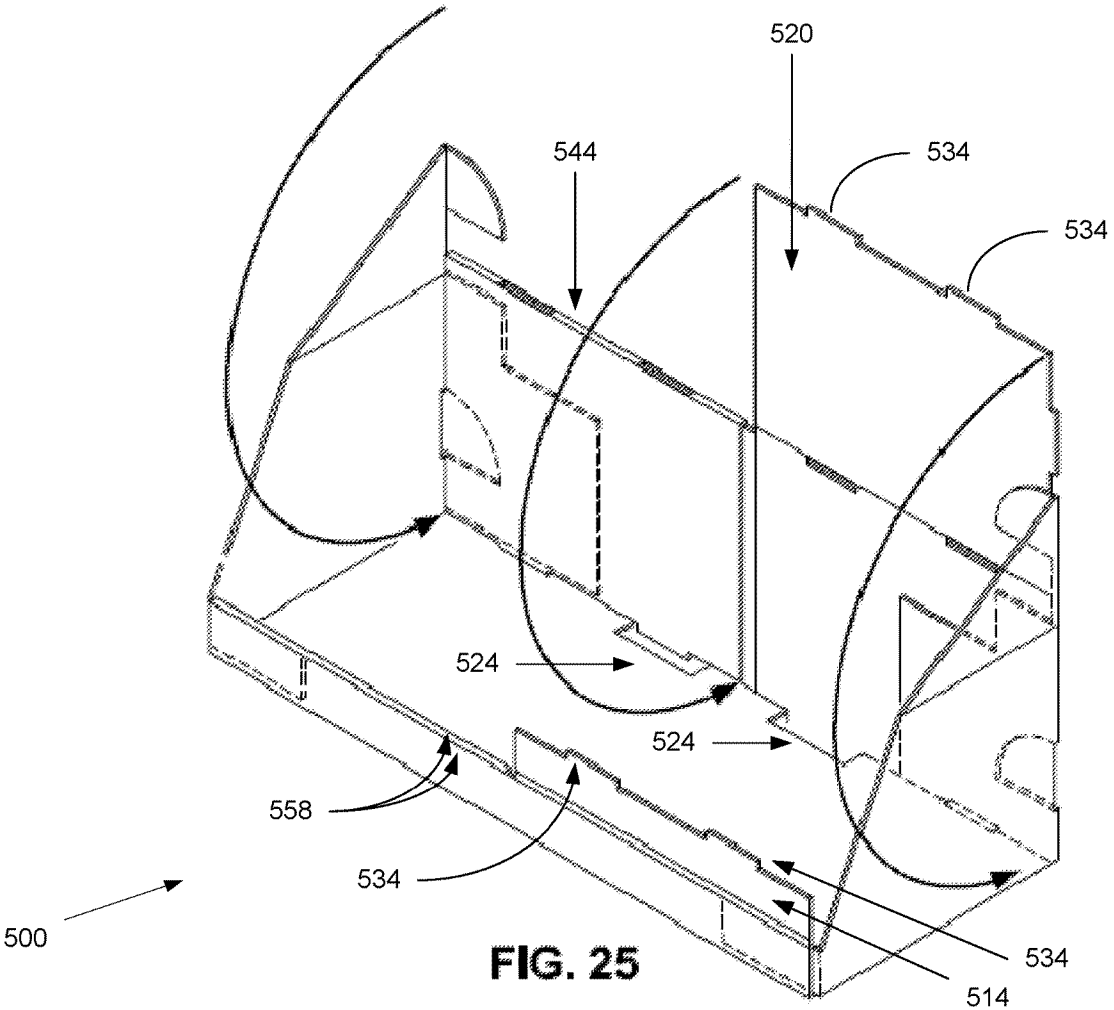

FIG. 25 illustrates the fourth step in folding the container blank 500. The container blank 500 is folded along the back panel score lines 544 in order to fold the back panel flaps 520 over the back panel inserts 512 (FIG. 20) such that the rectangular protrusions 534 are inserted into the bottom panel apertures 524. Similarly, the container blank 500 is also folded along the front panel score lines 558 such that the front panel flaps 514 are folded over the front panel inserts 518 (FIG. 20) such that the rectangular protrusions 534 extending from the front panel flaps 514 are inserted into the bottom panel apertures 524.

Figure 26:
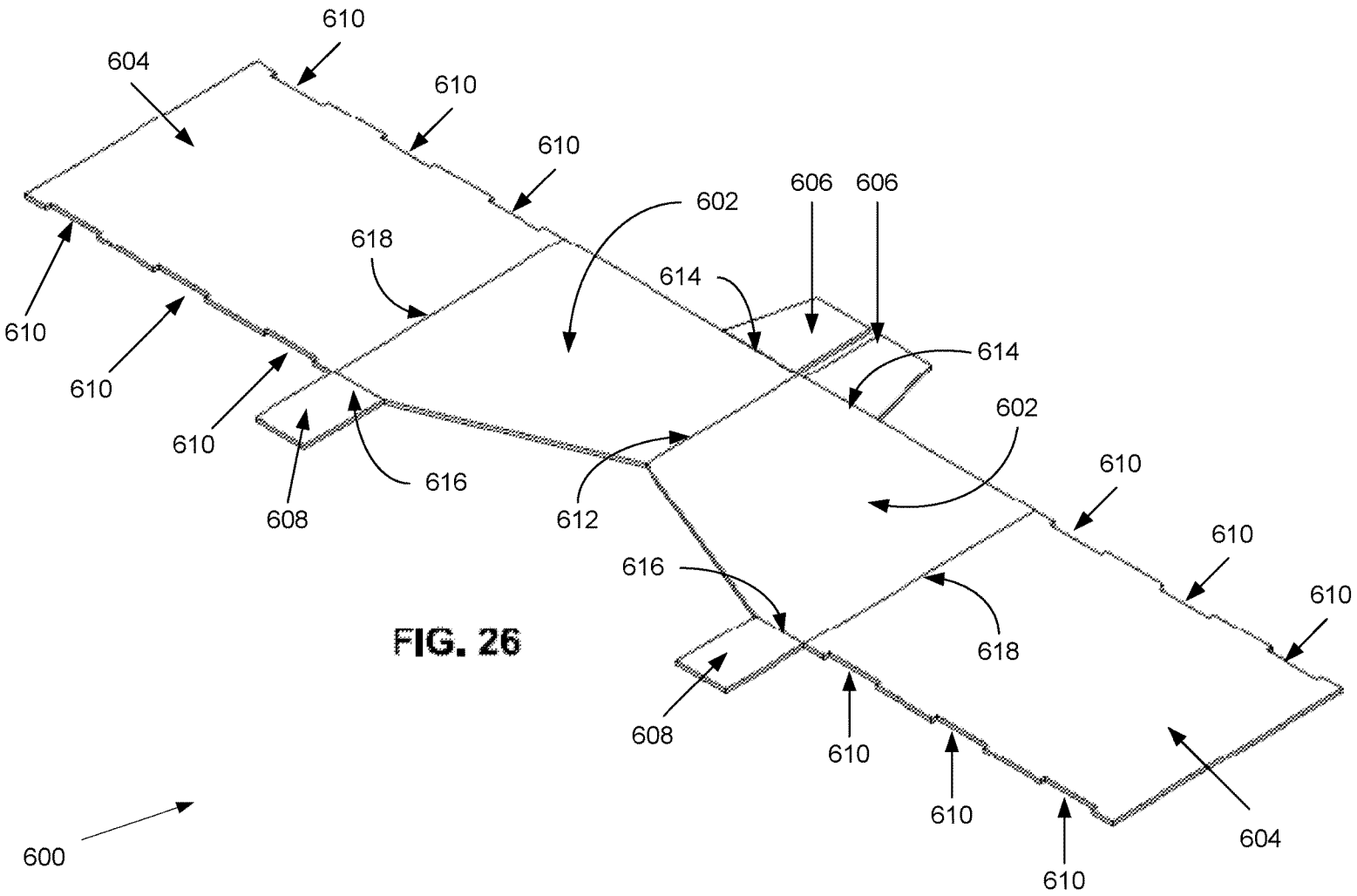
FIG. 26 is a drawing of a top plan view of an inner blank of FIG. 19 according to various embodiments of the present disclosure.

FIG. 26 illustrates a divider blank 600 that may be folded to assemble an insertable divider for an embodiment of the storage container 100 (FIG. 1). The divider blank 600 includes a partition panel 602. Extending from either side of the partition panel 602 are partition floors 604. Also extending from the partition panel 602 are rear panel inserts 606 and front panel inserts 608. The edges of the partition floors include multiple notches 610 through which the rectangular protrusions 534 (FIG. 20) of a container blank 500 (FIG. 20) may pass through when assembling the storage container 100. The divider blank 600 is also marked with a number of score marks, including the partition score mark 612 bisecting the partition panel 602, the rear score mark 614 separating the rear panel inserts 606 from the partition panel 602, the front score marks 616 separating the front panel inserts 608 from the partition panel 602, and the floor score marks 618 separating the partition floors 604 from the partition panel 602.

Figure 27:
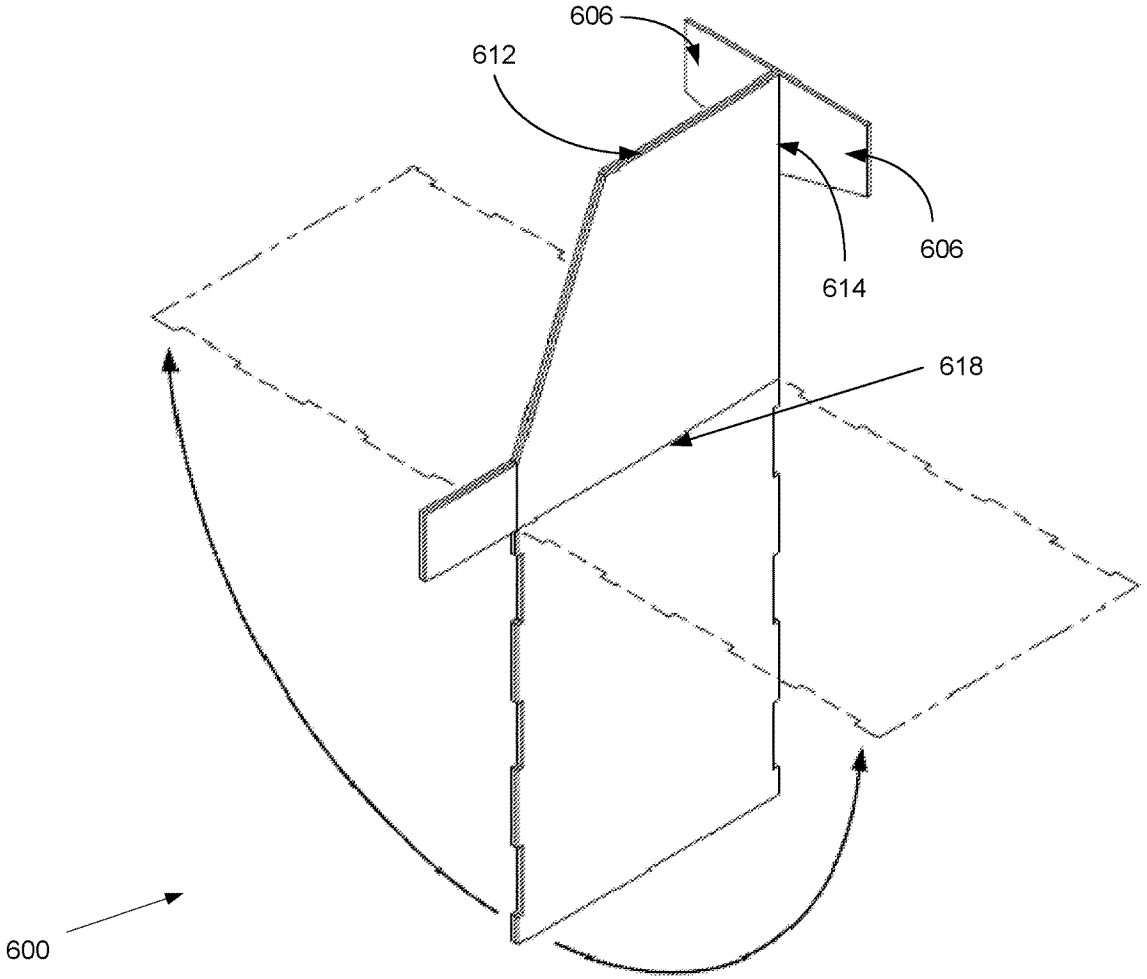
FIGS. 27-28 illustrate the folding of the inner blank of FIG. 26 to form an inner portion of an embodiment of the storage container of FIG. 1.

FIG. 27 illustrates how the divider blank 600 may be assembled. The divider blank 600 is folded along the partition score mark 612 to fold the divider blank 600 in half. The divider blank 600 is also folded along the rear score marks 614 to fold out the rear panel inserts 606 as shown. Subsequently, the divider blank 600 is then folded along each floor score mark 618 as illustrated.

Figure 28:
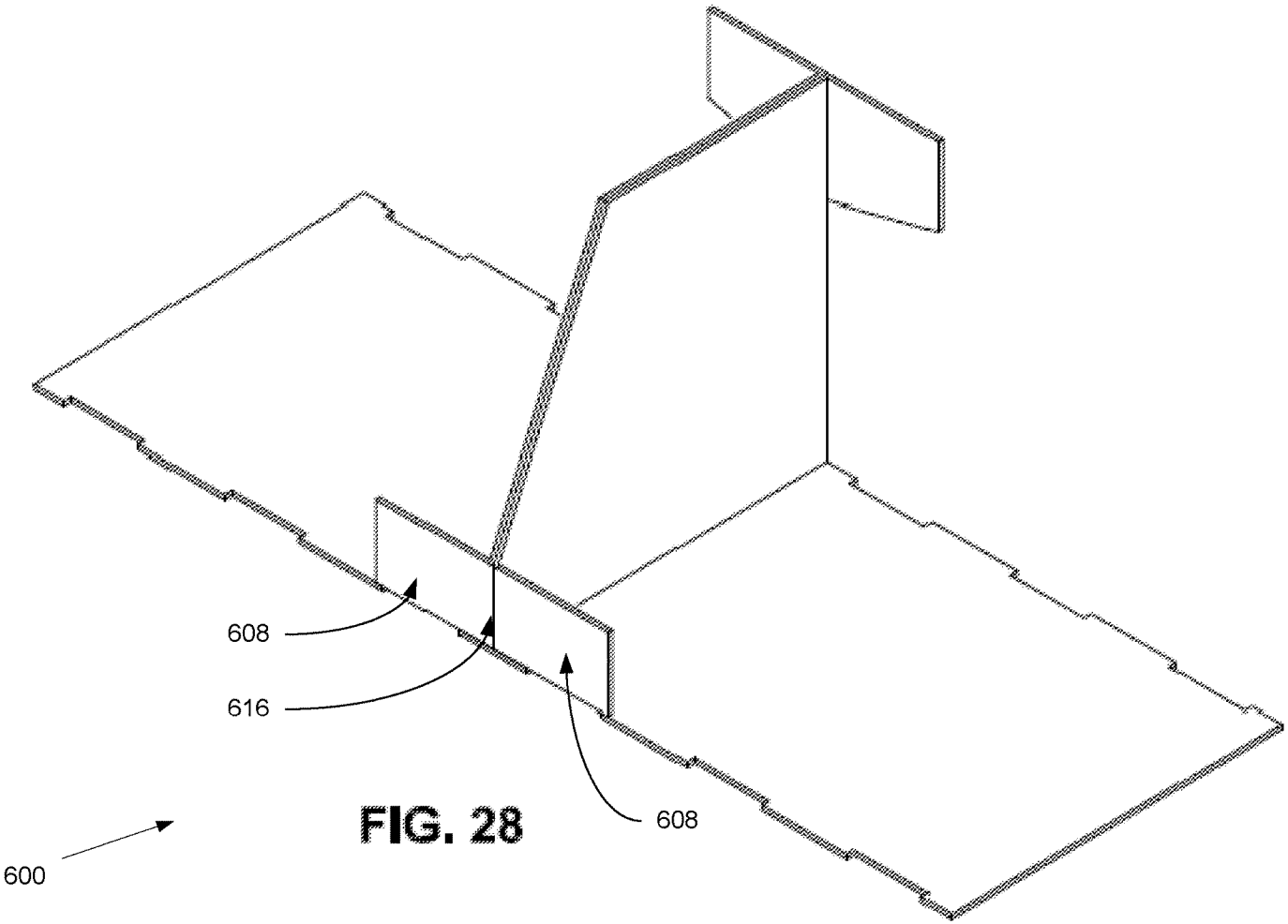

FIG. 28 illustrates the fully assembled divider blank 600 after a final fold along the front score marks 616 to position the front panel inserts 608 as shown. The assembled divider blank 600 may then be inserted into the partially assembled container blank 500, as illustrated in FIG. 25, and a finished storage container 100 assembled in a manner similar to that depicted in FIG. 15 and FIG. 16.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. A storage assembly, comprising:
- a shelf comprising a hole and an end extending past a back panel of a first container to attach the shelf to a vertical surface disposed behind the back panel;
- the first container comprising a bottom panel disposed on the shelf and a tab extending from the back panel of the first container;
- a second container comprising a slot; and
- the tab of the first container being configured to extend through the hole and be inserted into the slot of the second container, thereby anchoring the first container and the second container to the shelf.

2. The storage assembly of claim 1, wherein the back panel of the first container comprises a bottom edge and a top edge, and the tab extends from the bottom edge.

3. The storage assembly of claim 1, wherein the second container further comprises:
- a right quarter-circle tab attached to a right side panel flap of the second container;
- a left quarter-circle tab attached to a left side panel flap of the second container;
- a right slot positioned along a right side edge of the second container; and
- a left slot positioned along a left side edge of the second container.

4. The storage assembly of claim 3, wherein:
- the right quarter-circle tab of the at least one of the second container is configured to be inserted into a right slot of the first container; and
- the left quarter-circle tab of the at least one of the second container is configured to be inserted into a left slot of the first container.

5. The storage assembly of claim 1, wherein the first container comprises:
- a right quarter-circle tab attached to a right side panel flap of the first container, the right quarter-circle tab configured to be inserted into a right top panel aperture of the first container; and
- a left quarter-circle tab attached to a left side panel flap of the first container, the left quarter-circle tab configured to be inserted into a left top panel aperture of the first container.

6. The storage assembly of claim 1, wherein at least one of the first container or the second container is formable from a blank marked by a plurality of score lines.

7. The storage assembly of claim 1, further comprising a divider configured to be inserted into at least one of the first container or the second container, wherein the divider, when inserted, subdivides an interior of the first container or the second container into a plurality of chambers.

8. A storage system, comprising:
- a shelf comprising a hole and an end extending past a first back panel of a first container and a second back panel of a second container to attach the shelf to a vertical surface disposed behind the first back panel and the second back panel;
- the first container comprising a slot matching a size and location of the hole; and
- the second container comprising:
  - a bottom panel disposed on the shelf and
  - a tab configured to be inserted through the hole of the shelf into the slot of the first container to interlock the first container and the second container with the shelf.

9. The storage system of claim 8, wherein:
- the slot of the first container is a first slot;
- the tab of the second container is a first tab;
- the first container further comprises a second slot; and
- the second container further comprises a second tab attached to a side flap configured to fold around the shelf to insert the second tab into the second slot to further interlock the first container and the second container with the shelf.

10. The storage system of claim 8, wherein the slot of the first container is located on the top of the first container and the tab of the second container is located on the bottom of the second container.

11. The storage system of claim 8, wherein at least one of the first container or the second container comprises a divider configured to divide an interior of the first container or the second container into a plurality of compartments.

12. The storage system of claim 8, wherein at least one of the first container or the second container comprises cardboard.

13. A shelving system comprising:
- a first storage container comprising a first tab;
- a shelf comprising:

a hole configured to fit a portion of the first tab of the first storage container, and an end extending past a back panel of the first storage container to attach the shelf to a vertical surface disposed behind the back panel;

the first storage container comprising a bottom panel disposed on the shelf, the back panel, and the first tab extending from at least one of the bottom panel and the back panel such that the first tab is configured to extend through the hole of the shelf; and a second storage container comprising a slot positioned along a second edge of the back panel and configured to receive the first tab of the first storage container.

14. The shelving system of claim 13, wherein the first storage container comprises a divider that divides the first storage container into a plurality of chambers.

15. The shelving system of claim 13, wherein the first container or the second storage container comprises cardboard.

16. The shelving system of claim 13, wherein the second storage container further comprises:

a right quarter-circle tab attached to a right side panel flap of the second storage container;

a left quarter-circle tab attached to a left side panel flap of the second storage container;

a right slot positioned along a right side edge of the second storage container; and a left slot positioned along a left side edge of the second storage container.

17. The shelving system of claim 16, wherein:

the right quarter-circle tab of the second storage container is configured to be inserted into a right slot of the first storage container; and the left quarter-circle tab of the second storage container is configured to be inserted into a left slot of the first storage container.

18. The shelving system of claim 13, wherein the first storage container comprises:

a right quarter-circle tab attached to a right side panel flap of the first container, the right quarter-circle tab configured to be inserted into a right top panel aperture of the first container; and a left quarter-circle tab attached to a left side panel flap of the first container, the left quarter-circle tab configured to be inserted into a left top panel aperture of the first container.

* * * * *